US010564558B2

(12) United States Patent
Sugama et al.

(10) Patent No.: US 10,564,558 B2
(45) Date of Patent: Feb. 18, 2020

(54) ELECTROSTATIC CHARGE IMAGE DEVELOPING TONER AND TWO-COMPONENT DEVELOPER

(71) Applicant: Konica Minolta, Inc., Tokyo (JP)

(72) Inventors: Kouji Sugama, Musashino (JP); Kazumi Oura, Sagamihara (JP); Masaharu Matsubara, Hachioji (JP); Ikuko Sakurada, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/295,487

(22) Filed: Mar. 7, 2019

(65) Prior Publication Data

US 2019/0294067 A1 Sep. 26, 2019

(30) Foreign Application Priority Data

Mar. 20, 2018 (JP) ..... 2018-051927

(51) Int. Cl.

| | |
|---|---|
| ***G03G 9/08*** | (2006.01) |
| ***G03G 9/087*** | (2006.01) |
| ***G03G 9/113*** | (2006.01) |
| ***G03G 9/097*** | (2006.01) |

(52) U.S. Cl.

CPC ..... *G03G 9/08797* (2013.01); *G03G 9/08755* (2013.01); *G03G 9/08795* (2013.01); *G03G 9/09716* (2013.01); *G03G 9/1131* (2013.01)

(58) Field of Classification Search

CPC ..... G03G 9/08755; G03G 9/09716
USPC ..... 430/109.4, 108.7
See application file for complete search history.

(56) References Cited

U.S. PATENT DOCUMENTS

2016/0209770 A1* 7/2016 Nakamura ..... G03G 9/1133

FOREIGN PATENT DOCUMENTS

JP 2016-057475 A 4/2016

* cited by examiner

*Primary Examiner* — Mark A Chapman
(74) *Attorney, Agent, or Firm* — Lucas & Mercanti, LLP

(57) ABSTRACT

The electrostatic charge image developing toner of the present invention is an electrostatic charge image developing toner including a toner mother particle including at least a binding resin, and an external additive attached onto a surface of the toner mother particle, wherein a median size on a volume basis of the toner mother particle is in the range from 3.0 to 5.0 μm, the binding resin contains at least an amorphous polyester resin as a main component, and a spherical silica particle (1) having a number average particle size in the range from 20 to 55 nm is included as the external additive.

7 Claims, No Drawings

ELECTROSTATIC CHARGE IMAGE DEVELOPING TONER AND TWO-COMPONENT DEVELOPER

BACKGROUND

Technical Field

The present invention relates to an electrostatic charge image developing toner and a two-component developer, and relates to an electrostatic charge image developing toner that not only has favorable toner bottle dischargeability, but also can keep stable chargeability, in particular, can allow for formation of a high-quality image in continuous printing at a high image density.

Description of the Related Art

In recent years, a toner excellent in low-temperature fixability has been demanded in order to fix a toner image at a lower energy than a conventional case from the viewpoint of an increase in speed and energy saving.

It is necessary for a decrease in the fixing temperature of toner to decrease the melting temperature and the melting viscosity of a binding resin constituting toner. In order to achieve such low-temperature fixation of toner, there has been proposed a toner including a polyester resin as a main component of a binding resin (see, for example, Japanese Patent Laid-Open No. 2016-57475.).

Polyester resins have the property of having a relatively low softening point, and therefore have the advantage of allowing toner to ensure low-temperature fixability. Polyester resins also allows toner to have a reduced particle size, thereby enabling paper to be coated with a smaller amount of toner, and enabling the energy necessary for fixation to be reduced without any reduction in image density.

Meanwhile, a reduction in the particle size of toner also imparts favorable reproducibility of a fine latent image, and enables energy saving and an increase in image quality to be satisfied at the same time. In recent years, there has been a growing need for output of graphics and there has been increased output by printing at a high image density.

A toner having a reduced particle size, however, tends to be have deteriorated dischargeability from a toner bottle. Furthermore, such a toner has the problems of being insufficient in the rise of the amount of charge thereof, and of causing deterioration in image quality in continuous printing at a high image density.

SUMMARY

The present invention has been made in view of the above problems/circumstances, and an object thereof is to provide an electrostatic charge image developing toner and a two-component developer, in which a toner excellent in low-temperature fixability, including an amorphous polyester resin as a main component and having a reduced particle size, not only can be enchanted in toner fluidity and thus have favorable toner bottle dischargeability, but also can be enhanced in the rise of the amount of charge of a toner particle and thus keep stable chargeability, in particular, can allow for formation of a high-quality image in continuous printing at a high image density.

The present inventor has made studies about the causes of the problems in order to solve the problems, and has found that not only the particle size of a toner particle can be reduced and a spherical silica particle having a small particle size can be used as an external additive, but also a binding resin can contain an amorphous polyester resin as a main component, to thereby provide an electrostatic charge image developing toner and the like which can have favorable toner bottle dischargeability and also keep stable chargeability, in particular, which can allow for formation of a high-quality image in continuous printing at a high image density, thereby leading to the present invention.

That is, the problems of the present invention are solved by the following.

An electrostatic charge image developing toner according to one aspect of the present invention is an electrostatic charge image developing toner including a toner particle including a toner mother particle containing at least a binding resin, and an external additive attached onto a surface of the toner mother particle, wherein a median size on a volume basis of the toner particle is in the range from 3.0 to 5.0 μm, the binding resin contains at least an amorphous polyester resin as a main component, and a spherical silica particle (1) having a number average particle size in the range from 20 to 55 nm is included as the external additive.

DETAILED DESCRIPTION OF EMBODIMENTS

Hereinafter, one or more embodiment of the present invention will be described with reference to the drawings. However, the scope of the invention is not limited to the disclosed embodiments.

The above aspect of the present invention can provide an electrostatic charge image developing toner and a two-component developer, in which a toner excellent in low-temperature fixability, including an amorphous polyester resin as a main component and having a reduced particle size, not only can be enchanted in toner fluidity and thus have favorable toner bottle dischargeability, but also can be enhanced in the rise of the amount of charge of a toner particle and thus keep stable chargeability, in particular, can allow for formation of a high-quality image in continuous printing at a high image density.

The mechanisms for exerting or having the effects of the present invention, although not clear, are presumed as follows.

A toner having a reduced particle size is increased in attachability of the toner to a bottle member to result in deterioration in toner bottle dischargeability, but the toner, when including a small-sized spherical silica particle as an external additive, thus can be enhanced in toner fluidity, and therefore can achieve stable toner bottle dischargeability.

While the toner having a reduced particle size is increased in the surface area of the toner and thus is slowed in charge rise, the toner, when containing small-sized spherical silica, thus is increased in the number of contact points with a carrier, to thereby allow particle charge to rapidly progress, resulting in an enhancement in charge rise. Accordingly, charge rise can be enhanced and stable chargeability can be kept even in continuous printing at a high image density, and therefore a high-quality image favorable in image density stability and excellent in granularity can be obtained over a long period.

In particular, it has been found that a toner including an amorphous polyester resin as a main component and having a reduced particle size not only is excellent in low-temperature fixability and favorable in charge rise at the initial stage and in continuous printing, but also can allow a high-quality image to be obtained.

The reason for this is presumed as follows. While the percentage of coating with an external additive, relative the surface area of the toner, is needed to be in a proper range in terms of development/transfer properties and cleaning properties, a toner having a reduced particle size is larger in the surface area per certain volume of a toner particle and therefore not only is increased in the amount of an external additive based on the mass of the toner, but also is increased in the curvature of the toner particle and is decreased in the contact area of the toner particle with the external additive, thereby easily causing the external additive to be released. It is here considered that, since an amorphous polyester resin is high in affinity with small-sized spherical silica and therefore such small-sized spherical silica is hardly released in a toner including an amorphous polyester resin as a main component and having a reduced particle size, charge rise can be favorable and a high-quality image can be formed even at the initial stage and in continuous printing.

DETAILED DESCRIPTION OF EMBODIMENTS

The electrostatic charge image developing toner of the present invention is an electrostatic charge image developing toner including a toner particle including a toner mother particle containing at least a binding resin, and an external additive attached onto the surface of the toner mother particle, wherein the median size on a volume basis of the toner particle is in the range from 3.0 to 5.0 μm, the binding resin contains at least an amorphous polyester resin as a main component, and a spherical silica particle (1) having a number average particle size in the range from 20 to 55 nm is included as the external additive.

Such features are technical features which are common in the following respective embodiments or which correspond to those of such embodiments.

In an embodiment of the present invention, preferably, the spherical silica particle (1) having a number average particle size in the range from 20 to 55 nm, and a spherical silica particle (2) having a number average particle size in the range from 70 to 160 nm are included as the external additive. The spherical silica particle (2) has a spacer effect, and therefore is hardly embedded in the toner mother particle of the spherical silica particle (1) even when subjected to stress in a development device, and can allow favorable fluidity and charge rise properties to be kept and allow a high-quality image to be output over a long period.

The binding resin preferably contains an amorphous vinyl resin in an amount in the range from 0.1 to 20% by mass based on the total mass of the binding resin, in that the surface of the toner mother particle has a proper hardness to thereby hardly cause the spherical silica particle (1) to be embedded in the toner mother particle, resulting in an enhancement in charge rise properties and a high image quality in continuous printing.

The electrostatic charge image developing toner of the present invention is suitably used for a two-component developer, and the two-component developer contains a carrier particle formed by coating the surface of a core particle with a coating resin.

The percentage of exposed area of the core particle in the surface of the carrier particle is preferably in the range from 10.0 to 18.0%, in that not only the resistivity of the carrier particle is not too higher and a high-quality image can be output at the initial stage and after continuous printing, but also the carrier particle can be inhibited from being attached to an electrostatic latent image carrying member (electrophotographic photosensitive member) and no degradation in image quality in continuous printing is caused.

Hereinafter, the present invention and constituent components thereof, as well as modes and embodiments for carrying out the present invention will be described. In the present application, "to" described between numerical values is used to mean that the numerical values described before and after "to" are included as the lower limit and the upper limit, respectively.

[Electrostatic Charge Image Developing Toner]

The electrostatic charge image developing toner of the present invention is an electrostatic charge image developing toner including a toner particle including a toner mother particle containing at least a binding resin, and an external additive attached onto the surface of the toner mother particle, wherein the median size on a volume basis of the toner particle is in the range from 3.0 to 5.0 μm, the binding resin contains at least an amorphous polyester resin as a main component, and a spherical silica particle (1) having a number average particle size in the range from 20 to 55 nm is included as the external additive.

<Median Size on Volume Basis of Toner Particle>

The median size on a volume basis of the toner particle according to the present invention is measured and calculated with a measurement apparatus in which a computer system for data processing (manufactured by Beckman Coulter, Inc.) is connected to "Multisizer 3" (manufactured by Beckman Coulter, Inc.).

Specifically, 0.02 g of the toner particle is added to and admixed with 20 mL of a surfactant solution (a surfactant solution obtained by dilution of, for example, a neutral detergent containing a surfactant component, with pure water at 10-fold for the purpose of dispersing of the toner particle), and then ultrasonically dispersed for 1 minute to prepare a dispersion liquid of the toner particle, and the dispersion liquid of the toner particle is injected into a beaker in which "ISOTONII" (manufactured by Beckman Coulter, Inc.) in a sample stand is placed, until the concentration displayed in the measurement apparatus reaches 5 to 10%. The concentration can be set within the range, thereby providing a reproducible measurement value. The frequency value is calculated in conditions of a measurement particle count of 25000 and an aperture size of 100 μm in the measurement apparatus with the range from 2 to 60 μm as the measurement range being divided to 256 portions, and the particle size corresponding to 50% from the larger volume-integrated fraction is defined as the median size on a volume basis.

The median size on a volume basis of the toner particle according to the present invention is in the range from 3.0 to 5.0 μm. When the median size on a volume basis of the toner particle is 3.0 μm or more, toner fluidity is favorable and toner bottle dischargeability can be satisfied. In addition, charge rise properties are favorable, and a high-quality image can be obtained at the initial stage and after continuous printing. When the median size on a volume basis of the toner particle is 5.0 μm or less, low-temperature fixability is enhanced. In addition, a high-quality image excellent in toner dot reproducibility of a fine latent image and excellent in granularity at the initial stage and after continuous printing is obtained. The median size on a volume basis of the toner particle according to the present invention is more preferably in the range from 3.5 to 4.5 μm.

The median size on a volume basis of the toner particle can be controlled by, for example, the timing of an amorphous polyester resin loaded and the amount thereof added in aggregation/fusion in production of the toner particle described below, the concentration of a coagulant and the amount of a solvent added, the fusion time, or the composition of a resin component.

<Toner Mother Particle>

The toner mother particle according to the present invention contains at least a binding resin.

The toner mother particle according to the present invention may contain, if necessary, other constituent component(s) such as a release agent (wax), a colorant, and a charge control agent.

In the present invention, a toner mother particle to which an external additive is added is referred to as a "toner particle" and an aggregate of the toner particle is referred to as a "toner". While the toner mother particle can also be generally used as the toner particle even as it is, the toner mother particle to which an external additive is added is used as the toner particle in the present invention.

<Binding Resin>

The binding resin according to the present invention contains at least an amorphous polyester resin as a main component.

The binding resin according to the present invention preferably contains an amorphous vinyl resin, and may further contain a crystalline polyester resin.

(Amorphous Polyester Resin)

In the present invention, the main component means a resin contained at the highest content in the binding resin, and is contained at a content of 50% by mass or more in the binding resin.

The amorphous polyester resin according to the present invention is preferably contained in the range from 60 to 90% by mass in the binding resin from the viewpoint that excellent fixability is achieved. Herein, the binding resin corresponds to the entire toner resin.

The amorphous polyester resin according to the present invention is a resin which is a polyester resin and which has no melting point and a relatively high glass transition temperature (Tg) in differential scanning calorimetry (DSC). The monomer constituting the amorphous polyester resin is different from the monomer constituting the crystalline polyester resin, and therefore can be distinguished from the crystalline polyester resin by, for example, analysis with NMR.

The Tg of the amorphous polyester resin is preferably in the range from 35 to 80° C., particularly preferably in the range from 45 to 65° C.

The glass transition temperature can be measured according to a method (DSC method) prescribed in ASTM (Standards of American Society for Testing and Materials) D3418-82. For the measurement, a DSC-7 differential scanning calorimeter (manufactured by PerkinElmer Co., Ltd.), a TACT/DX thermal analyzer controller (manufactured by PerkinElmer Co., Ltd.), or the like can be used.

The amorphous polyester resin is obtained by a polycondensation reaction of a di- or higher-valent carboxylic acid (polyvalent carboxylic acid) and a di- or higher-hydric alcohol (polyhydric alcohol). A specific amorphous polyester resin is not particularly limited, and a conventionally known amorphous polyester resin in the art can be used.

A specific method for producing the amorphous polyester resin is not particularly limited, and the resin can be produced by polycondensation (esterification) of a polyvalent carboxylic acid and a polyhydric alcohol by use of a known esterification catalyst.

The catalyst, the polycondensation (esterification) temperature, and the polycondensation (esterification) time which can be used in such production are not particularly limited, and are the same as in a crystalline polyester resin described below.

The weight average molecular weight (Mw) of the amorphous polyester resin is not particularly limited, and is, for example, preferably in the range from 5000 to 100000, more preferably in the range from 5000 to 50000. When the weight average molecular weight (Mw) is 5000 or more, heat-resistant storage properties of the toner can be enhanced, and when the Mw is 100000 or less, low-temperature fixability can be more enhanced. The weight average molecular weight (Mw) can be measured by a method described below.

Examples of the polyvalent carboxylic acid and the polyhydric alcohol for use in preparation of the amorphous polyester resin are not particularly limited, and include the following.

<<Polyvalent Carboxylic Acid>>

Examples include aromatic carboxylic acids such as terephthalic acid, isophthalic acid, phthalic anhydride, trimellitic acid anhydride, pyromellitic acid and naphthalenedicarboxylic acid, aliphatic carboxylic acids such as maleic anhydride, fumaric acid, succinic acid, alkenyl succinic anhydride and adipic acid, and alicyclic carboxylic acids such as cyclohexanedicarboxylic acid. These polyvalent carboxylic acids can be used singly or in combinations of two or more thereof. Among these polyvalent carboxylic acids, aromatic carboxylic acids are preferably used, and a tri- or higher-valent carboxylic acid (for example, trimellitic acid or anhydride thereof) is preferably used in combination with any dicarboxylic acid in order that a crosslinked structure or a branched structure is taken for securement of more favorable fixability.

Examples of the tri- or higher-valent carboxylic acid include 1,2,3-benzenetricarboxylic acid, 1,2,4-benzenetricarboxylic acid, 1,3,5-benzenetricarboxylic acid and 1,2,4-naphthalenetricarboxylic acid, and anhydrides thereof and lower alkyl esters thereof. These may be used singly or in combinations of two or more thereof.

<<Polyhydric Alcohol>>

Examples include aliphatic diols such as ethylene glycol, diethylene glycol, triethylene glycol, propylene glycol, butane diol, hexane diol, neopentyl glycol and glycerin, alicyclic diols such as cyclohexane diol, cyclohexanedimethanol and hydrogenerated bisphenol A, and aromatic diols such as an ethylene oxide adduct of bisphenol A and a propylene oxide adduct of bisphenol A. These polyhydric alcohols can be used singly or in combinations of two or more thereof. Among these polyhydric alcohols, aromatic diols and alicyclic diols are preferable, and in particular, aromatic diols are more preferable. A tri- or higher polyhydric alcohol (glycerin, trimethylolpropane, or pentaerythritol) may be used in combination with any diol in order that more favorable fixability is ensured and a crosslinked structure or a branched structure is taken.

Herein, a monocarboxylic acid and/or a monoalcohol may be further added to the polyester resin obtained by polycondensation of the polyvalent carboxylic acid and the polyhydric alcohol, to esterify a hydroxy group and/or a carboxy group at a polymerization terminal, thereby adjusting the acid value of the polyester resin.

Examples of the monocarboxylic acid can include acetic acid, acetic anhydride, benzoic acid, trichloroacetic acid, trifluoroacetic acid and propionic anhydride, and examples of the monoalcohol can include methanol, ethanol, propanol, octanol, 2-ethylhexanol, trifluoroethanol, trichloroethanol, hexafluoroisopropanol and phenol.

(Amorphous Vinyl Resin)

The binding resin according to the present invention preferably contains an amorphous vinyl resin in an amount in the range from 0.1 to 20% by mass, more preferably in the range from 0.2 to 10% by mass, particularly preferably in the range from 0.3 to 5% by mass.

When the amorphous vinyl resin is contained in an amount in the range from 0.1 to 20% by mass, the surface of the toner mother particle has a proper hardness, and therefore a spherical silica particle (1) described below is hardly embedded in the toner mother particle, charge rise properties is enhanced in continuous printing and the quality of an image to be formed is high. When the content of the amorphous vinyl resin is 20% by mass or less, favorable low-temperature fixability is obtained.

Herein, the amorphous vinyl resin by itself may be contained in the binding resin, or the amorphous vinyl resin may be contained in the form of a composite resin where an amorphous vinyl resin component is hybridized.

The vinyl resin according to the present invention is not particularly limited as long as the resin is obtained by polymerization of a vinyl compound, and examples include a (meth)acrylate resin, a styrene-(meth)acrylate resin and an ethylene-vinyl acetate resin. These may be used singly or in combinations of two or more thereof.

Among the above vinyl resins, a styrene-(meth)acrylate resin is preferable in consideration of plasticity in heat fixing. Accordingly, a styrene-(meth)acrylate resin (hereinafter, also referred to as "styrene-(meth)acrylic resin") as an amorphous resin will be described hereinafter.

The styrene-(meth)acrylic resin is formed by addition polymerization of at least a styrene monomer and a (meth) acrylate monomer. The styrene monomer here mentioned encompasses not only styrene represented by a structural formula of $CH_2{=}CH{-}C_6H_5$, but also styrene having a structure where known side chain and functional group is included in a styrene structure.

The (meth)acrylate monomer here mentioned encompasses not only acrylate and methacrylate represented by $CH_2{=}CHCOOR$ (R represents an alkyl group), but also an acrylate derivative and a methacrylate derivative each having a structure having known side chain and functional group. Herein, the "(meth)acrylate monomer" collectively means an "acrylate monomer" and a "methacrylate monomer".

Examples of the styrene monomer and the (meth)acrylate monomer which can form the styrene-(meth)acrylic resin are shown below.

Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene. These styrene monomers can be used singly or in combinations of two or more thereof.

Specific examples of the (meth)acrylate monomer include acrylate monomers such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; and methacrylates such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate. These (meth)acrylate monomers can be used singly or in combinations of two or more thereof.

The content of the constituent unit derived from the styrene monomer in the styrene-(meth)acrylic resin is preferably in the range from 40 to 90% by mass based on the total amount of the resin. The content of the constituent unit derived from the (meth)acrylate monomer in the resin is preferably in the range from 10 to 60% by mass based on the total amount of the resin. The styrene-(meth)acrylic resin may further contain the following monomer compound, in addition to the styrene monomer and the (meth)acrylate monomer.

Examples of such a monomer compound include carboxy group-containing compounds such as acrylic acid, methacrylic acid, maleic acid, itaconic acid, cinnamic acid, fumaric acid, maleic acid monoalkyl ester and itaconic acid monoalkyl ester; and hydroxy group-containing compounds such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate and 4-hydroxybutyl (meth)acrylate. These monomer compounds can be used singly or in combinations of two or more thereof.

The content of the constituent unit derived from the monomer compound in the styrene-(meth)acrylic resin is preferably in the range from 0.5 to 20% by mass based on the total amount of the resin.

The weight average molecular weight (Mw) of the styrene-(meth)acrylic resin is preferably in the range from 10000 to 100000.

The method for producing the styrene-(meth)acrylic resin is not particularly limited, and examples include a method where polymerization is performed by use of any polymerization initiator usually used for polymerization of the monomer, such as peroxide, persulfide, persulfate or an azo compound, according to a known polymerization procedure such as bulk polymerization, solution polymerization, emulsion polymerization, a mini-emulsion method or a dispersion polymerization method. A chain transfer agent generally used for the purpose of molecular weight adjustment can be used. The chain transfer agent is not particularly limited, and examples can include alkylmercaptan such as n-octylmercaptan, and mercapto fatty acid ester.

(Crystalline Polyester Resin)

The binding resin according to the present invention preferably contains a crystalline polyester resin from the viewpoint that flexibility of the toner mother particle is enhanced and a silica particle is suitably easily fixed, and also from the viewpoint of low-temperature fixability.

In the present invention, the crystalline resin refers to a resin not exhibiting any stepwise endothermic change, but having a clear endothermic peak, in differential scanning calorimetry (DSC). The clear endothermic peak specifically means a peak where the half-value width of an endothermic peak in measurement at a rate of temperature rise of 10° C./min in differential scanning calorimetry (DSC) is within 15° C.

The melting point Tmc of the crystalline resin is preferably 60° C. or more from the viewpoint that sufficient high-temperature stability is obtained, and is preferably 85° C. or less from the viewpoint that sufficient low-temperature fixability is obtained.

The melting point Tmc of the crystalline resin can be measured by DSC. Specifically, 0.5 mg of a crystalline resin sample is encapsulated in an aluminum pan "KIT-NO.B0143013", and set up in a sample holder of a thermal analysis apparatus "Diamond DSC" (manufactured by PerkinElmer Co., Ltd.), and the temperature is varied in the order of heating, cooling and heating. The temperature is raised from 0° C. to 150° C. at a rate of temperature rise of 10° C./min and kept at a temperature of 150° C. for 5 minutes at the first and second heatings, and the temperature is dropped from 150° C. to 0° C. at a rate of temperature drop of 10° C./min and kept at a temperature of 0° C. for 5 minutes in the cooling. The temperature at the peak top of the endothermic peak in the endothermic curve obtained in the second heating is measured as the melting point (Tmc) of the crystalline resin.

The content of the crystalline polyester resin relative to the toner mother particle is preferably in the range from 5 to 20% by mass, more preferably in the range from 7 to 15% by mass from the viewpoint that sufficient low-temperature fixability is obtained.

When the content is 5% by mass or more, a sufficient plasticizing effect is obtained, and low-temperature fixability is excellent. When the content is 20% by mass or less, thermal stability and stability against physical stress, of the toner, are sufficient.

The number average molecular weight (Mn) of the crystalline polyester resin is preferably in the range from 2000 to 10000, more preferably in the range from 3000 to 7000. When the Mn is in the range, strength of an image fixed is not insufficient, and neither the crystalline resin is pulverized in stirring of a developer, nor an excessive plasticizing effect decreases the glass transition temperature Tg of the toner to result in deterioration in thermal stability of the toner. In addition, sharp melt properties are exhibited, and low-temperature fixation can be made.

The Mn can be determined from a molecular weight distribution measured by gel permeation chromatography (GPC) as follows.

A sample is added to tetrahydrofuran (THF) so that the concentration is 0.1 mg/mL, and warmed to 40° C. and dissolved, and thereafter the resulting solution is treated by a membrane filter having a pore size of 0.2 μm, thereby preparing a sample liquid. A GPC apparatus HLC-8220GPC (manufactured by Tosoh Corporation) and a column "TSK gel Super HZ3000" (manufactured by Tosoh Corporation) are used to allow THF as a carrier solvent to flow at a flow rate of 0.6 mL/min with the column temperature being kept at 40° C. The carrier solvent and also 100 μL of the sample liquid prepared are injected into the GPC apparatus, and the sample is subjected to detection with a differential refractive index detector (RI detector). The calibration curve created by measurement at 10 points with respect to a monodispersed polystyrene standard particle is used to calculate the molecular weight distribution of the sample. If any peak due to the filter is here confirmed in data analysis, a region before the peak is set as the baseline.

The crystalline polyester resin according to the present invention is obtained by a polycondensation reaction of a di- or higher-valent carboxylic acid (polyvalent carboxylic acid) and a di- or higher-hydric alcohol (polyhydric alcohol). A conventionally known crystalline polyester resin in the art can be used as the crystalline polyester resin.

Examples of the polyvalent carboxylic acid and the polyhydric alcohol for use in preparation of the crystalline polyester resin include the following.

<<Polyvalent Carboxylic Acid>>

Examples of the polyvalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid, and aromatic dicarboxylic acids, for example, diprotic acids, such as phthalic acid, isophthalic acid, terephthalic acid, naphthalene-2,6-dicarboxylic acid, malonic acid and mesaconic acid, as well as anhydrides thereof and lower alkyl esters thereof, but are not limited thereto.

Examples of the tri- or higher-valent carboxylic acid include 1,2,3-benzenetricarboxylic acid, 1,2,4-benzenetricarboxylic acid, 1,3,5-benzenetricarboxylic acid and 1,2,4-naphthalenetricarboxylic acid, and anhydrides thereof and lower alkyl esters thereof. These may be used singly or in combinations of two or more thereof.

The content of the constituent unit derived from the aliphatic dicarboxylic acid relative to the constituent unit derived from the dicarboxylic acid in the crystalline polyester resin is preferably 50% by mol or more, more preferably 70% by mol or more, further preferably 80% by mol or more, particularly preferably 100% by mol from the viewpoint that crystallinity of crystalline polyester is sufficiently ensured.

<<Polyhydric Alcohol>>

Specific examples of the aliphatic diol suitably used for synthesis of the crystalline polyester include ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol and 1,14-eicosanedecane diol, but are not limited thereto. Among them, 1,6-hexane diol, 1,8-octane diol, 1,9-nonane diol and 1,10-decane diol are preferable in consideration of availability.

Examples of a tri- or higher-hydric alcohol include glycerin, trimethylolethane, trimethylolpropane and pentaerythritol. These may be used singly or in combinations of two or more thereof.

The content of the constituent unit derived from the aliphatic diol relative to the constituent unit derived from the diol in the crystalline polyester resin is preferably 50% by mol or more, more preferably 70% by mol or more, further preferably 80% by mol or more, particularly preferably 100% by mol from the viewpoint of enhancements in low-temperature fixability of the toner and glossiness of an image finally formed.

The ratio of the diol and the dicarboxylic acid in the monomer of the crystalline polyester resin is preferably in the range from 2.0/1.0 to 1.0/2.0, more preferably in the range from 1.5/1.0 to 1.0/1.5, particularly preferably in the range from 1.3/1.0 to 1.0/1.3 in terms of the equivalent ratio [OH]/[COOH] of the hydroxy group [OH] of the diol and the carboxy group [COOH] of the dicarboxylic acid.

The monomer forming the crystalline polyester resin preferably contains 50% by mass or more, more preferably 80% by mass or more of a linear aliphatic monomer. When an aromatic monomer is used, the melting point of the crystalline polyester resin highly tends to be high, and when a branched aliphatic monomer is used, crystallinity highly tends to be low. Accordingly, a linear aliphatic monomer is preferably used in the monomer.

A linear aliphatic monomer is preferably used at a content of 50% by mass or more, more preferably 80% by mass or more from the viewpoint that crystallinity of the crystalline polyester resin in the toner is kept.

The crystalline polyester resin can be synthesized by polycondensation (esterification) of the polyvalent carboxylic acid and the polyhydric alcohol by use of a known esterification catalyst.

The catalyst which can be used for synthesis of the crystalline polyester resin may be one or more catalysts, and examples thereof include compounds of alkali metals such as sodium and lithium; compounds containing Group 2 elements such as magnesium and calcium; compounds of metals such as aluminum, zinc, manganese, antimony, titanium, tin, zirconium and germanium; phosphorus acid compounds; phosphoric acid compounds; and amine compounds.

Specifically, examples of the tin compound include dibutyltin oxide, tin octylate, tin dioctylate, and salts thereof. Examples of the titanium compound include titanium alkoxides such as tetra-n-butyl titanate, tetraisopropyl titanate, tetramethyl titanate and tetrastearyl titanate; titanium acrylates such as polyhydroxytitanium stearate; and titanium chelates such as titanium tetraacetylacetonate, titanium lactate and titanium triethanol aminate. Examples of the germanium compound include germanium dioxide, and examples of the aluminum compound include oxides such as polyaluminum hydroxide, aluminum alkoxide and tributyl aluminate.

The polymerization temperature of the crystalline polyester resin is preferably in the range from 150 to 250° C. The polymerization time is preferably 0.5 to 10 hours. In polymerization, the reaction system may be, if necessary, under reduced pressure.

<Release Agent>

Any of known various waxes can be used as the release agent according to the present invention. Examples of such waxes include polyolefin waxes such as polyethylene wax and polypropylene wax, branched hydrocarbon waxes such as microcrystalline wax, long-chain hydrocarbon-based waxes such as paraffin wax and sasol wax, dialkyl ketone-based waxes such as distearyl ketone, ester-based waxes such as carnauba wax, montan wax, behenyl behenate, trimethylolpropane tribehenate, pentaerythritol tetrabehenate, pentaerythritol diacetate dibehenate, glycerin tribehenate, 1,18-octadecane diol distearate, tristearyl trimellitate and distearyl maleate, and amide-based waxes such as ethylenediamine behenylamide and trimellitic acid tristearylamide. Such release agents may be used singly or in combinations of two or more thereof.

The content of the release agent is preferably in the range from 1 to 30 parts by mass, more preferably in the range from 2 to 20 parts by mass based on 100 parts by mass of the binding resin.

<Colorant>

Any colorant can be added to the toner mother particle according to the present invention.

Any known colorant can be used for the colorant according to the present invention. Specifically, examples of a colorant contained in a yellow toner include C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112 and C.I. Solvent Yellow 162, and C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180 and C.I. Pigment Yellow 185. These can be used singly or in combinations of two or more thereof.

Examples of a colorant contained in a magenta toner include C.I. Solvent Red 1, C.I. Solvent Red 49, C.I. Solvent Red 52, C.I. Solvent Red 58, C.I. Solvent Red 63, C.I. Solvent Red 111 and C.I. Solvent Red 122, and C.I. Pigment Red 5, C.I. Pigment Red 48: 1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222. These can be used singly or in combinations of two or more thereof.

Examples of a colorant contained in a cyan toner include C.I. Pigment Blue 15:3.

Examples of a colorant contained in a black toner include carbon black, a magnetic material and titanium black. Examples of the carbon black include channel black, furnace black, acetylene black, thermal black and lamp black.

Examples of the magnetic material include ferromagnetic metals such as iron, nickel and cobalt, alloys containing such ferromagnetic metals, ferromagnetic metal compounds such as ferrite and magnetite, and alloys not any ferromagnetic metal, but exhibiting ferromagnetic properties due to a heat treatment. Examples of the alloy exhibiting ferromagnetic properties due to a heat treatment include Hensler alloys such as manganese-copper-aluminum and manganese-copper-tin, and chromium dioxide.

The content of the colorant is preferably in the range from 1 to 10 parts by mass, more preferably in the range from 2 to 9 parts by mass based on 100 parts by mass of the binding resin.

<Charge Control Agent>

The charge control agent is not particularly limited as long as it is a substance which can impart positive or negative charge due to frictional charge, and any of known various positive charge control agents and negative charge control agents can be used. Examples thereof include a nigrosine-based dye, a metal salt of naphthenic acid or higher fatty acid, alkoxylated amine, a quaternary ammonium salt compound, an azo-based metal complex and a salicylic acid metal salt.

The content of the charge control agent is preferably in the range from 0.01 to 30 parts by mass, more preferably in the range from 0.1 to 10 parts by mass based on 100 parts by mass of the binding resin.

<External Additive>

The external additive according to the present invention contains a spherical silica particle (1) having a number average particle size in the range from 20 to 55 nm.

When the number average particle size of the spherical silica particle (1) is in the range from 25 to 55 nm, not only toner fluidity can be enhanced to allow for securement of toner bottle dischargeability, but also charge rise properties can be enhanced to provide a high-quality image excellent in image density stability and granularity at the initial stage and after continuous printing. In particular, the number average particle size of the spherical silica particle (1) is more preferably in the range from 30 to 45 nm.

In the present invention, the spherical silica particle (1) having a number average particle size in the range from 20 to 55 nm, and a spherical silica particle (2) having a number average particle size in the range from 70 to 160 nm are included as the external additive.

The spherical silica particle (2) having a number average particle size of 70 to 160 nm has a spacer effect and therefore is hardly embedded in the toner mother particle of the spherical silica particle (1) even when subjected to stress in a development device, and is increased in fluidity and is also decreased in releasing from the toner. Therefore, generation of a toner aggregate due to moisture adsorption can be suppressed, and thus a high-quality image is obtained.

(Spherical Silica Particle)

The "spherical shape" of the spherical silica particle (1) and the spherical silica particle (2) according to the present invention means that the sphericity is 0.6 or more. The sphericity is more preferably 0.8 or more.

In the present invention, the sphericity refers to the Wadell's true sphericity. That is, the sphericity is represented by the following Expression (A).

Sphericity=(Surface area of sphere having the same volume as in actual particle)/(Surface area of actual particle) Expression (A):

The "Surface area of sphere having the same volume as in actual particle" can be here determined from the number average particle size determined by the following method, according to arithmetic calculation. The "Surface area of actual particle" can be replaced with the BET specific surface area determined with a "powder specific surface area measuring apparatus SS-100" (manufactured by Shimadzu Corporation).

(Number Average Particle Size of Silica Particle)

A scanning electron microscope (SEM) "JSM-7401F" (manufactured by JEOL Ltd.) is used to take a SEM photograph of the toner enlarged at a magnification of 30000 times, the SEM photograph is observed to measure the particle size (Feret size) of the primary particle of the silica particle, and the total value is divided by the number of particle objects to determine the average particle size. The particle size is measured with selection of a region of a SEM image, in which the total number of particle objects is about 100 to 200.

The spherical silica particle (1) and the spherical silica particle (2) are each preferably a spherical silica particle produced by a sol/gel method. The spherical silica particle produced by a sol/gel method is preferable because the particle size thereof is more uniform (narrow particle size distribution, namely, monodispersity) than that of fumed silica obtained by a general production method.

The spherical silica particle (1) and the spherical silica particle (2) are preferably uniform in particle size distribution. A spherical silica particle uniform in particle size distribution is evenly attached to the surface of the toner mother particle, and therefore toner fluidity and charge rise properties are stable.

(Standard Deviation of Number Average Particle Size of Spherical Silica Particle>

The dispersivity in the particle size distribution of the spherical silica particle can be discussed in terms of the standard deviation of the number average particle size in consideration of an aggregate. The standard deviation of the number average particle size of the spherical silica particle (1) preferably corresponds to "number average particle size×0.22 or less, further preferably "number average particle size×0.15 or less". Similarly, the standard deviation of the number average particle size of the spherical silica particle (2) preferably corresponds to "number average particle size×0.22 or less", further preferably "number average particle size×0.15 or less".

The amount of the spherical silica particle (1) added is preferably in the range from 0.3 to 2.5 parts by mass, more preferably in the range from 0.5 to 2.3 parts by mass based on 100 parts by mass of the toner mother particle. When the amount added is 0.3 parts by mass or more, attachability of the toner particle to a bottle member is reduced to result in an enhancement in bottle dischargeability. When the amount added is 2.5 parts by mass or less, the spherical silica particle can be inhibited from being detached from the toner particle, and the amount of charge can be stabilized even in continuous printing at a high image density, resulting in formation of a high-quality image.

The amount of the spherical silica particle (2) added is preferably in the range from 0.1 to 2.0 parts by mass, more preferably in the range from 0.3 to 1.8 parts by mass based on 100 parts by mass of the toner mother particle.

(Other External Additive(s))

As the external additive according to the present invention, a conventionally known metal oxide particle other than the spherical silica particle (1) and the spherical silica particle (2) can be used for the purpose of control of fluidity and chargeability. Examples include silica particles having a non-spherical shape, other than the spherical silica particles (1) and (2), such as a titania particle, an alumina particle, a zirconia particle, a zinc oxide particle, a chromium oxide particle, a cerium oxide particle, an antimony oxide particle, a tungsten oxide particle, a tin oxide particle, a tellurium oxide particle, a manganese oxide particle and a boron oxide particle. These can be used singly or in combinations of two or more thereof.

An organic fine particle of a homopolymer of styrene, methyl methacrylate, or the like, or a copolymer thereof may also be used as the external additive.

A metal oxide particle for use as the external additive according to the present invention is preferably one whose surface is subjected to a hydrophobization treatment with a known surface treatment agent such as a coupling agent.

The surface treatment agent is preferably dimethyldimethoxysilane, hexamethyldisilazane (HMDS), methyltrimethoxysilane, isobutyltrimethoxysilane, decyltrimethoxysilane, or the like.

A silicone oil can also be used as the surface treatment agent. Specific examples of the silicone oil can include an organosiloxane oligomer, a cyclic compound such as octamethylcyclotetrasiloxane, decamethylcyclopentasiloxane, tetramethylcyclotetrasiloxane or tetravinyltetramethylcyclotetrasiloxane, and linear or branched organosiloxane. A high-reactive silicone oil at least modified at a terminal with introduction of a modification group to a side chain, one terminal, both terminals, one terminal of a side chain, both terminals of a side chain, and/or the like may be used. Examples of the modification group include an alkoxy group, a carboxy group, a carbinol group, higher fatty acid modification, a phenol group, an epoxy group, a methacrylic group and an amino group, but are not particularly limited thereto. The modification group may be, for example, a silicone oil having several kinds of modification groups such as amino/alkoxy modification groups.

A dimethylsilicone oil and the modified silicone oil, and furthermore other surface treatment agent may be used for a mixing treatment or a combination treatment. Examples of a combination treatment agent can include a silane coupling agent, a titanate-based coupling agent, an aluminate-based coupling agent, various silicone oils, fatty acid, a fatty acid metal salt, an esterified product thereof, and rosin acid.

In order to further enhance cleaning properties and transfer properties, a lubricant can also be used as the external additive. Examples include metal salts of higher fatty acids, such as zinc, aluminum, copper, magnesium, and calcium salts of stearic acid, zinc, manganese, iron, copper, and magnesium salts of oleic acid, zinc, copper, magnesium, and calcium salts of palmitic acid, zinc and calcium salts of linoleic acid, and zinc and calcium salts of ricinoleic acid.

The amount of such other external additive is preferably smaller than the amounts of the spherical silica particle (1) and the spherical silica particle (2) according to the present invention, and is preferably in the range from 0.1 to 2.0% by mass, more preferably in the range from 0.1 to 1.6% by mass relative to the entire toner mother particle.

<Form of Toner Mother Particle>

The toner mother particle may have a so-called monolayer structure, or may have a core/shell structure (a resin for formation of a shell layer is aggregated and fused on the surface of a core particle), and preferably has a core/shell structure from the viewpoint that low-temperature fixability is more favorable.

The core/shell structure here is not limited to a structure where a core particle is completely coated with a shell layer, and examples thereof include a structure where a core particle is not completely coated with a shell layer and the core particle is exposed here and there.

The form of the toner according to the present invention is preferably a form where the crystalline polyester resin is not exposed on the surface of the toner mother particle and is contained in the toner mother particle, and the amorphous resin is exposed on the surface of the toner mother particle, from the viewpoint that chargeability under a high-temperature and high-humidity environment is enhanced. The form of the toner mother particle of the toner can be controlled by the number of carbon atoms in the polyvalent carboxylic acid component and the polyhydric alcohol component forming the crystalline polyester resin. The form of the toner mother particle can also be controlled by the timing of addition of each resin in production of the toner mother particle according to an emulsion aggregation method, as described below.

The form of the toner mother particle (the cross section structure of the core/shell structure and the position of presence of the crystalline polyester resin) can be confirmed using, for example, a known procedure such as a transmission electron microscope (IBM) or a scanning probe microscope (SPM).

<Average Degree of Circularity of Toner Particle>

The average degree of circularity of the toner particle is preferably in the range from 0.935 to 0.995, more preferably in the range from 0.945 to 0.990, further preferably in the range from 0.955 to 0.980. The average degree of circularity in such a range allows each toner particle to be hardly ground and allows the amount of charge to be stable, resulting in a high image quality.

The average degree of circularity can be measured using, for example, a flow type particle image analyzer "FPIA-3000" (manufactured by Sysmex Corporation).

[Method for Producing Toner]

The method for producing the toner according to the present invention is not particularly limited, a known method can be adopted therefor, and an emulsion polymerization aggregation method or an emulsion aggregation method can be suitably adopted.

An emulsion polymerization aggregation method preferably used for the method for producing the toner according to the present invention is a method for producing a toner mother particle, in which a dispersion liquid of a fine particle of a binding resin (hereinafter, also referred to as "binding resin fine particle".) produced by an emulsion polymerization method is mixed with a dispersion liquid of a fine particle of a colorant (hereinafter, also referred to as "colorant fine particle".) and a dispersion liquid of a release agent such as wax, aggregation is conducted until a toner mother particle having a desired particle size is obtained, and furthermore the binding resin fine particle is subjected to fusion to thereby perform shape controlling.

An emulsion aggregation method preferably used for the method for producing the toner according to the present invention is a method for producing a toner mother particle, in which a binding resin solution dissolved in a solvent is dropped into a poor solvent to provide a resin particle dispersion liquid, the resin particle dispersion liquid is mixed with a colorant dispersion liquid and a dispersion liquid of a release agent such as wax, aggregation is conducted until a toner mother particle having a desired particle size is obtained, and furthermore the binding resin fine particle is subjected to fusion to thereby perform shape controlling.

A toner mother particle having a core/shell structure can also be obtained by such an emulsion polymerization aggregation method, and specifically the toner mother particle having a core/shell structure can be obtained by first producing a core particle by aggregation, association, and fusion of a binding resin fine particle for the core particle and a fine particle of a colorant, and then adding a binding resin fine particle for a shell layer, into a dispersion liquid of the core particle, to allow the binding resin fine particle for a shell layer to be aggregated and fused to the surface of the core particle, thereby forming a shell layer with which the surface of the core particle is coated.

<Method for Adding External Additive>

The method for adding the external additive to the toner mother particle is not particularly limited, and examples include a dry method in which an external additive powder is added to a dry toner mother particle and the resultant is mixed.

As the mixing apparatus of the external additive, known various mixing apparatuses such as a Turbula mixer, a Henschel mixer, a Nauta mixer, and a V-type mixing machine can be used. For example, when a Henschel mixer is used, the circumferential velocity of the tip of a stirring blade is preferably in the range from 30 to 80 m/s, and stirring and mixing are conducted at 20 to 50° C. for about 10 to 30 minutes.

[Two-Component Developer]

The toner according to the present invention can also be used as a magnetic or non-magnetic one-component developer, and is preferably mixed with a carrier and thus used as a two-component developer.

When the toner is used as a two-component developer, the carrier preferably contains a carrier particle formed by coating the surface of a core particle with a coating resin.

(Core Particle)

As the core particle, a magnetic particle made of a conventionally known material, for example, a metal such as iron, ferrite or magnetite, or an alloy of such a metal and a metal such as aluminum or lead can be used, and a ferrite particle is particularly preferable.

Not only a coated carrier obtained by coating the surface of the core particle such as the magnetic particle with a coating resin, but also a dispersion type carrier in which a magnetic material fine powder is dispersed in a binder resin may also be used as the carrier.

The volume average particle size of the core particle is generally in the range from 10 to 500 μm, preferably in the range from 30 to 100 μm.

The volume average particle size ($D_{50}$) of the core particle is measured using a laser diffraction type particle size distribution measurement apparatus "HEROSKA" (manufactured by Japan Laser Corp.) according to a wet method. Specifically, first, an optical system at a focus position of 200 mm is selected, and the measurement time is set to 5 seconds. A magnetic material particle for measurement is then added to an aqueous 0.2% by mass sodium dodecyl sulfate solution, and dispersed using an ultrasonic washing machine "US-1" (manufactured by As One Corporation) for 3 minutes to produce a sample dispersion liquid for measurement, several droplets of the sample dispersion liquid are fed to "HEROS KA", and measurement is started at a time when the sample concentration gauge reaches a measurable range. The resulting particle size distribution is used to create the cumulative distribution from the smaller size with respect to the particle size range (channel), and the particle size at an accumulation of 50% is defined as the volume average particle size ($D_{50}$).

(Coating Resin)

The coating resin according to the present invention is preferably formed from a copolymer containing an alicyclic methacrylate monomer.

The alicyclic methacrylate monomer can be used to thereby reduce hygroscopicity and suppress a reduction in the amount of charge at high-temperature and high-humidity. In addition, a proper mechanical strength is imparted to allow for film wearing of a coating material, thereby resulting in refreshing of the surface of the carrier particle.

The copolymer rate of the alicyclic methacrylate monomer is preferably 50% or more, more preferably 75% or more.

The alicyclic methacrylate monomer preferably has a cycloalkyl group having 5 to 8 carbon atoms, and specific examples include cyclopentyl methacrylate, cyclohexyl methacrylate, cycloheptyl methacrylate and cyclooctyl methacrylate. Among them, cyclohexyl methacrylate is particularly preferable from the viewpoint of environment stability of mechanical strength and the amount of charge.

The percentage of exposed area of the core particle in the surface of the carrier particle is preferably in the range from 10.0 to 18.0%. When the percentage of exposed area is 10.0% or more, the resistivity of the carrier particle is not too higher, and a high-quality image can be output at the initial stage and after continuous printing. When the percentage of exposed area is 18.0% or less, the carrier particle can be inhibited from being attached to an electrostatic latent image carrying member (electrophotographic photosensitive member) and no degradation in image quality in continuous printing is caused.

In measurement of an exposed region of the core particle in the surface of the carrier particle, the percentage of coating of the core particle with the coating resin is determined by XPS measurement (X-ray photoelectron spectroscopic measurement) according to the following method.

K-Alpha manufactured by Thermo Fisher Scientific is used as an XPS measurement apparatus, and measurement is performed using A1 monochromatic X-ray as an X-ray source set to an acceleration voltage of 7 kV and an emission current of 6 mV with respect to a main element (usually carbon) constituting the coating resin and a main element (usually iron) constituting the core particle.

The ratio of the toner to the total of the carrier and the toner (toner concentration) is preferably in the range from 4.0 to 8.0% by mass. When the ratio of the toner particle is in the range from 4.0 to 8.0% by mass, the amount of charge of the toner is appropriate and the image quality at the initial stage and after continuous printing is more favorable.

The two-component developer according to the present invention can be produced by mixing the carrier and the toner by use of a mixing apparatus. Examples of the mixing apparatus can include a Henschel mixer, a Nauta mixer and a V-type mixing machine.

[Image Formation Method]

The image formation method according to the present invention includes forming an image formation layer on a recording medium by use of the toner according to the present invention.

The image formation method according to the present invention is a method of using the toner according to the present invention, and can be suitably used for a full-color image formation method. The full-color image formation method usable can be any image formation method, for example, a method using a four-cycle image formation apparatus constituted from four color development apparatuses for respective yellow, magenta, cyan and black colors, and one electrostatic latent image carrying member (also referred to as "electrophotographic photosensitive member" or simply referred to as "photosensitive member"), or a method using a tandem image formation apparatus where image formation units having color development apparatuses and electrostatic latent image carrying members for respective colors are mounted with respect to such colors.

In the case of further use of a clear toner, any image formation method can be used, for example, a method using a five-cycle image formation apparatus constituted from five color development apparatuses of respective yellow, magenta, cyan, black and clear colors, and one electrostatic latent image carrying member (also referred to as "electrophotographic photosensitive member" or simply referred to as "photosensitive member"), or a method using a tandem image formation apparatus where image formation units having development apparatuses and electrostatic latent image carrying members for respective colors including a clear toner are mounted with respect to such colors.

Examples of the image formation method preferably include an image formation method including fixing in a heat-pressure fixing system which can allow for pressure application and also heating.

The image formation method can specifically allow a printed material where a visible image is formed to be obtained by, for example, developing an electrostatic latent image formed on the photosensitive member by use of the toner, to provide a toner image, transferring the toner image to an image support and thereafter fixing the toner image transferred to the image support, to the image support, by a fixing treatment in a heat-pressure fixing system.

The pressure application and the heating in the fixing are preferably conduced at the same time, and the pressure application may be first conducted and the heating may be subsequently conducted.

The image formation method according to the present invention is suitably used for an image formation method in a heat-pressure fixing system. Any of known various apparatuses can be adopted for a fixing apparatus in a heat-pressure fixing system for use in the image formation method according to the present invention. Hereinafter, a heat roller-type fixing apparatus and a belt heating type fixing apparatus serving as a heat pressure fixing apparatus will be described.

(i) Heat Roller-Type Fixing Apparatus

A heat roller-type fixing apparatus generally includes a pair of rollers of a heating roller and a pressure roller that abuts thereto. The fixing apparatus has a so-called fixing nipper formed on a deformed portion by deformation of the pressure roller due to the pressure applied between the heating roller and the pressure roller.

The heating roller is generally obtained by disposing a heat source such as a halogen lamp in a cored bar made of a hollow metal roller made of aluminum or the like. The heating roller conducts heating of the cored bar by the heat source. The temperature here is modulated by control of connection to the heat source so that the outer periphery of the heating roller is kept at a predetermined fixing temperature.

The fixing apparatus preferably has the following configuration in the case of use for an image formation apparatus that conducts formation of a full-color image, the image formation apparatus being demanded to have the ability to sufficiently heat and melt toner images including four toner layers (yellow, magenta, cyan and black) or five toner layers (yellow, magenta, cyan, black and clear) and to perform color mixing.

That is, the fixing apparatus preferably includes, as the heating roller, a heating roller including a cored bar having a high heat capacity and including an elastic layer for uniform melting of toner images, formed on the outer periphery of the cored bar.

The pressure roller includes an elastic layer made of flexible rubber such as urethane rubber or silicone rubber.

The pressure roller that may be used is a pressure roller including a cored bar made of a hollow metal roller made of aluminum or the like and including an elastic layer formed on the outer periphery of the cored bar.

Furthermore, the pressure roller, in the case of including such a cored bar, may include a heat source, such as a halogen lamp, provided in the cored bar, as in the heating roller. The pressure roller may be configured to be modulated in the temperature thereof by control of connection to the heat source so that the outer periphery of the pressure roller is kept at a predetermined fixing temperature by heating of the cored bar by the heat source.

The heating roller and the pressure roller to be used preferably have a release layer as the outermost layer, formed from, for example, a fluororesin such as polytetrafluoroethylene (PTFE) or a tetrafluoroethylene-perfluoroalkyl vinyl ether copolymer (PFA).

Such a heat roller-type fixing apparatus allows the pair of rollers to rotate, to sandwich an image support, on which a visible image is to be formed, and convey it to the fixing nipper, and thus performs heating by the heating roller and application of pressure on the fixing nipper, resulting in fixation of an unfixed toner image to the image support.

The image formation method according to the present invention is also improved in low-temperature fixability. Accordingly, the temperature of the heating roller can be relatively lower and can be specifically 150° C. or less in the heat roller-type fixing apparatus. The temperature of the heating roller is preferably 140° C. or less, more preferably 135° C. or less. A lower temperature of the heating roller is more preferable from the viewpoint of excellent low-temperature fixability, and the lower limit is substantially about 90° C., but not particularly limited thereto.

(ii) Belt Heating Type Fixing Apparatus

A belt heating type fixing apparatus generally includes, for example, a heating member of a ceramic heater, a pressure roller, and a fixing belt of a heat-resistant belt, sandwiched between the heating member and the pressure roller, and includes a so-called fixing nipper formed on a deformed portion by deformation of the pressure roller due to the pressure applied between the heating member and the pressure roller.

The fixing belt to be used is, for example, a heat-resistant belt or sheet made of polyimide or the like. The fixing belt may have a configuration where a heat-resistant belt or sheet made of polyimide or the like is adopted as a substrate and a release layer made of a fluororesin such as polytetrafluoroethylene (PTFE) or a tetrafluoroethylene-perfluoroalkyl vinyl ether copolymer (PFA) is formed on the substrate, and may also have such a configuration where an elastic layer made of rubber or the like is further provided between the substrate and the release layer.

Such a belt heating type fixing apparatus allows an image support, on which an unfixed toner image is carried, to be sandwiched between the fixing belt for formation of the fixing nipper and the pressure roller and conveyed together with the fixing belt. Thus, the fixing apparatus performs heating by the heating member via the fixing belt and application of pressure on the fixing nipper, resulting in fixation of such an unfixed toner image to the image support.

Such a belt heating type fixing apparatus may allow the heating member to generate heat at a predetermined fixing temperature by connection to the heating member only in image formation. Accordingly, the fixing apparatus can result in a reduction in a waiting time which is taken from turning on of the power source of an image formation apparatus to executable image formation. An additional advantage is that the power consumed in a standby condition of an image formation apparatus is extremely low to result in electric power saving.

As described above, the heating member, the pressure roller and the fixing belt for use as a fixing member in the fixing preferably have a multilayer structure.

The temperature of the heating member in the belt heating type fixing apparatus can be relatively low, and can be specifically 150° C. or less. The temperature of the heating member is preferably 140° C. or less, more preferably 135° C. or less. A lower temperature of the heating member is more preferable from the viewpoint of excellent low-temperature fixability. The lower limit is substantially about 90° C., but not particularly limited thereto.

<Recording Medium>

Any recording medium (also referred to as "recording material", "recording paper" or "recording sheet") commonly used may be adopted, and such a recording medium is not particularly limited as long as it can retain any toner image formed according to a known image formation method with an image formation apparatus or the like. Examples of the image support that can be used include plain paper including thin paper and heavy paper, premium grade paper, art paper, coated printing paper such as coated paper, commercially available Japanese paper and postcard paper, plastic films for OHP, cloths, various resin materials for use in so-called soft packaging, and resin films and labels obtained by molding of such materials into films.

While embodiments of the present invention are described, the present invention is not limited to the embodiments and can be variously modified.

Examples

Hereinafter, the present invention will be specifically described with reference to Examples, but the present invention is not intended to be limited thereto.

<Preparation of Amorphous Polyester Resin Particle Dispersion Liquid (a1)>

<<Production of Amorphous Polyester Resin (A1)>>

2.2 mol Adduct of bisphenol A ethylene oxide: 40 parts by mol 2.2 mol Adduct of bisphenol A propylene oxide: 60 parts by mol Dimethyl terephthalate: 60 parts by mol Dimethyl fumarate: 15 parts by mol Dodecenylsuccinic anhydride: 20 parts by mol Trimellitic anhydride: 5 parts by mol A reaction vessel equipped with a stirrer, a thermometer, a condenser and a nitrogen gas introduction tube was charged with monomers other than dimethyl fumarate and trimellitic anhydride and 0.25 parts by mass of tin dioctylate, among the above-recited monomers, based on 100 parts by mass of the total of the monomers. After a reaction was allowed to run at 235° C. for 6 hours under a nitrogen gas stream, the temperature was dropped to 200° C., and dimethyl fumarate and trimellitic anhydride were added to allow a reaction to run for 1 hour. The temperature was raised to 220° C. over 5 hours, and polymerization was made at a pressure of 10 kPa until a desired molecular weight was obtained, thereby providing light yellow and clear amorphous polyester resin (A1).

Amorphous polyester resin (A1) had a weight average molecular weight of 35000, a number average molecular weight of 8000 and a glass transition temperature (Tg) of 56° C.

<<Preparation of Amorphous Polyester Resin Particle Dispersion Liquid (a1)>>

Next, 200 parts by mass of amorphous polyester resin (A1), 100 parts by mass of methyl ethyl ketone, 35 parts by mass of isopropyl alcohol and 7.0 parts by mass of an aqueous 10% by mass ammonia solution were placed in a separable flask, and sufficiently mixed and dissolved, thereafter ion exchange water was added dropwise using a liquid feed pump at a liquid feed rate of 8 g/min with heating and stirring at 40° C., and the dropping was terminated when the amount of the liquid fed reached 580 parts by mass. Thereafter, the solvent was removed under reduced pressure, and an amorphous polyester resin particle dispersion liquid was obtained. Ion exchange water was added to the dispersion liquid for adjustment so that the solid content was 25% by mass, thereby preparing amorphous polyester resin particle dispersion liquid (a1). The median size on a volume basis ($D_{50}$) with respect to the dispersion liquid was measured with Microtrack UPA-150 (manufactured by Nikkiso Co., Ltd.), and was 156 nm.

<Preparation of Amorphous Vinyl Resin Particle Dispersion Liquid (b1)>

A 5-L reaction vessel equipped with a stirring apparatus, a temperature sensor, a condenser tube and a nitrogen introduction apparatus was charged with 5.0 parts by mass of an anionic surfactant (Dowfax manufactured by Dow Chemical Company) and 2500 parts by mass of ion exchange water, and the interior temperature was raised to 75° C. with stirring at a stirring rate of 230 rpm under a nitrogen stream.

Next, a solution containing 18.0 parts by mass of potassium persulfate (KPS) dissolved in 342 parts by mass of ion exchange water was added, and the liquid temperature was set to 75° C. Furthermore, a monomer-mixed liquid including 903.0 parts by mass of styrene (St), 282.0 parts by mass of n-butyl acrylate (BA) and 12.0 parts by mass of acrylic acid (AA), and also 3.0 parts by mass of 1,10-decane diol diacrylate and 8.1 parts by mass of dodecanethiol was added dropwise over 2 hours.

After completion of the dropwise addition, polymerization was made by heating and stirring at 75° C. over 2 hours, thereby providing an amorphous vinyl resin particle dispersion liquid. Ion exchange water was added to the dispersion liquid for adjustment so that the solid content was 25% by mass, thereby preparing particle dispersion liquid (b1) of amorphous vinyl resin (B1). The median size on a volume basis ($D_{50}$) with respect to the dispersion liquid was measured with Microtrack UPA-150 (manufactured by Nikkiso Co., Ltd.), and was 160 nm.

Amorphous vinyl resin (B1) had a glass transition temperature (Tg) of 52° C., a weight average molecular weight (Mw) of 38000 and a number average molecular weight (Mn) of 15000.

<Preparation of Crystalline Polyester Resin Particle Dispersion Liquid (c1)>

<<Production of Crystalline Polyester Resin (C1)>>

Dodecanoic diacid: 50 parts by mol 1,6-Hexane diol: 50 parts by mol

A reaction vessel equipped with a stirrer, a thermometer, a condenser and a nitrogen gas introduction tube was charged with the monomers, and the content of the reaction vessel was purged with a dry nitrogen gas. Next, 0.25 parts by mass of titanium tetrabutoxide ($Ti(O\text{-}n\text{-}Bu)_4$) was placed based on 100 parts by mass of the total of the monomers. After a reaction was performed with stirring at 170° C. for 3 hours, the temperature was further raised to 210° C. over 1 hour, the pressure in the reaction vessel was reduced to 3 kPa, and a reaction was allowed to run under reduced pressure for 13 hours, thereby providing crystalline polyester resin (C1).

Crystalline polyester resin (C1) had a weight average molecular weight of 25000, a number average molecular weight of 8500 and a melting point of 71.8° C.

<<Preparation of Crystalline Polyester Resin Particle Dispersion Liquid (c1)>>

Next, 200 parts by mass of crystalline polyester resin (C1), 120 parts by mass of methyl ethyl ketone and 30 parts by mass of isopropyl alcohol were placed in a separable flask, and sufficiently mixed and dissolved at 60° C., and thereafter 8 parts by mass of an aqueous 10% by mass ammonia solution was added dropwise. The heating temperature was dropped to 67° C., ion exchange water was added dropwise using a liquid feed pump at a liquid feed rate of 8 g/min with stirring, and such dropwise addition of ion exchange water was terminated when the amount of the liquid fed reached 580 parts by mass. Thereafter, the solvent was removed under reduced pressure, and a crystalline polyester resin particle dispersion liquid was obtained. Ion exchange water was added to the dispersion liquid for adjustment so that the solid content was 25% by mass, thereby preparing crystalline polyester resin particle dispersion liquid (c1). The median size on a volume basis ($D_{50}$) with respect to the dispersion liquid was measured with Microtrack UPA-150 (manufactured by Nikkiso Co., Ltd.), and was 198 nm.

<Preparation of Release Agent Particle Dispersion Liquid (W1)>

Paraffin-based wax (HNP 0190 manufactured by Nippon Seiro Co., Ltd., melting temperature: 85° C.): 270 parts by mass Anionic surfactant (Neogen RK manufactured by DKS Co. Ltd.): 13.5 parts by mass (effective component: 60%, 3% relative to release agent)

Ion exchange water: 21.6 parts by mass

After the above materials were mixed and the release agent was dissolved at an internal liquid temperature of 120° C. in a high-pressure discharge type homogenizer (Gaulin Homogenizer manufactured by Gaulin Inc.), the resultant was subjected to a dispersing treatment at a dispersing pressure of 5 MPa for 120 minutes and subsequently at 40 MPa for 360 minutes, and cooled, thereby providing a dispersion liquid. The ion exchange water was added for adjustment so that the solid content was 20%, and the resultant was defined as release agent particle dispersion liquid (W1). The particle in the release agent particle dispersion liquid (W1) had a volume average particle size of 215 nm.

<Preparation of Colorant Particle Dispersion Liquid>

<<Preparation of Black Colorant Particle Dispersion Liquid (1)>>

Carbon black (Regal (registered trademark) 330 manufactured by Cabot Corporation): 100 parts by mass Anionic surfactant (Neogen SC manufactured by DKS Co. Ltd.): 15 parts by mass Ion exchange water: 400 parts by mass After the components were mixed and pre-dispersed in a homogenizer (ULTRA-TURRAX T50, manufactured by IKA Werke) for 10 minutes, the resultant was subjected to a dispersing treatment with a high-pressure impact type disperser altimizer (manufactured by Sugino Machine Limited) at a pressure of 245 MPa for 30 minutes, thereby providing an aqueous black colorant particle dispersion liquid. The ion exchange water was further added to the resulting dispersion liquid for adjustment so that the solid content was 15% by mass, thereby preparing black colorant particle dispersion liquid (1). The median size on a volume basis ($D_{50}$) of the colorant particle in the dispersion liquid was measured with Microtrack UPA-150 (manufactured by Nikkiso Co., Ltd.), and was 110 nm.

<Production of Toner Mother Particle (1)>

<<Aggregation/Fusion and Aging>>

Amorphous polyester resin particle dispersion liquid (a1): 1008 parts by mass

Amorphous vinyl resin particle dispersion liquid (b1): 32 parts by mass

Crystalline polyester resin particle dispersion liquid (c1): 160 parts by mass

Release agent particle dispersion liquid (W1): 160 parts by mass

Black colorant particle dispersion liquid (1): 187 parts by mass

Anionic surfactant (aqueous 20% Dowfax 2A1 solution): 40 parts by mass

Ion exchange water: 1500 parts by mass

The above materials were placed in a 4-L reaction vessel equipped with a thermometer, a pH meter and a stirrer, and 1.0% nitric acid was added at a temperature of 25° C. to adjust the pH to 3.0. Thereafter, 100 parts by mass of an aqueous aluminum sulfate (coagulant) solution having a concentration of 2% was added over 30 minutes with dispersing by a homogenizer (ULTRA-TURRAX T50, manufactured by IKA Werke) at 3000 rpm. After completion of the dropwise addition, stirring was made for 10 minutes, thereby sufficiently mixing the raw materials and the coagulant.

Thereafter, a stirrer and a mantle heater were mounted to the reaction vessel to raise the temperature to 40° C. at a rate of temperature rise of 0.2° C./min and to more than 40° C. at a rate of temperature rise of 0.05° C./min with the number of rotations of the stirrer being adjusted so that a slurry was sufficiently stirred, and the particle size was measured by a Coulter Multisizer 3 (aperture size: 100 μm, manufactured by Beckman Coulter, Inc.) every 10 minutes. Once a median size on a volume basis of 3.9 μm was obtained, the temperature was here kept, and a previously mixed liquid of amorphous polyester resin particle dispersion liquid (a1): 400 parts by mass and anionic surfactant (aqueous 20% Dowfax 2A1 solution): 15 parts by mass was placed over 20 minutes.

Next, the temperature was kept at 50° C. for 30 minutes, thereafter 8 parts by mass of a 20% EDTA (ethylenediaminetetraacetic acid) liquid were added into the reaction vessel, and thereafter an aqueous 1 mol/L sodium hydroxide solution was added thereto to control the pH of the raw material dispersion liquid to 9.0. Thereafter, while the pH was adjusted to 9.0 every 5° C., the temperature was raised to 85° C. at a rate of temperature rise of 1° C./min and kept at 85° C.

<<Cooling>>

Thereafter, once the shape coefficient was 0.970 according to "FPIA-3000", the resultant was cooled at a rate of temperature drop of 10° C./min, thereby providing toner mother particle dispersion liquid (1).

<<Filtering/Washing and Drying>>

Thereafter, toner mother particle dispersion liquid (1) was subjected to filtration and the residue was sufficiently washed with ion exchange water. Next, the resultant was dried at 40° C., thereby providing toner mother particle (1). Toner mother particle (1) obtained had a median size on a volume basis of 4.0 μm and an average degree of circularity of 0.971.

<Production of Toner Mother Particle (2)>

The same manner as in the production of toner mother particle (1) was performed except that, once the median size on a volume basis was 2.9 μm, the temperature was kept and amorphous polyester resin particle dispersion liquid (a1): 400 parts by mass and anionic surfactant (aqueous 20% Dowfax 2A1 solution): 15 parts by mass previously mixed were added, thereby producing toner mother particle (2). Toner mother particle (2) obtained had a median size on a volume basis of 3.0 μm and an average degree of circularity of 0.972.

<Production of Toner Mother Particle (3)>

The same manner as in the production of toner mother particle (1) was performed except that, once the median size on a volume basis was 4.9 μm, the temperature was kept and amorphous polyester resin particle dispersion liquid (a1): 400 parts by mass and anionic surfactant (aqueous 20% Dowfax 2A1 solution): 15 parts by mass previously mixed were added, thereby producing toner mother particle (3). Toner mother particle (3) obtained had a median size on a volume basis of 5.0 μm and an average degree of circularity of 0.969.

<Production of Toner Mother Particle (12)>

The same manner as in the production of toner mother particle (1) was performed except that, once the median size on a volume basis was 2.7 μm, the temperature was kept and amorphous polyester resin particle dispersion liquid (a1): 400 parts by mass and anionic surfactant (aqueous 20% Dowfax 2A1 solution): 15 parts by mass previously mixed were added, thereby producing toner mother particle (12). Toner mother particle (12) obtained had a median size on a volume basis of 2.8 μm and an average degree of circularity of 0.971.

<Production of Toner Mother Particle (13)>

The same manner as in the production of toner mother particle (1) was performed except that, once the median size on a volume basis was 5.1 μm, the temperature was kept and amorphous polyester resin particle dispersion liquid (a1): 400 parts by mass anionic surfactant (aqueous 20% Dowfax 2A1 solution): 15 parts by mass previously mixed were added, thereby producing toner mother particle (13). Toner mother particle (13) obtained had a median size on a volume basis of 5.2 μm and an average degree of circularity of 0.972.

<Production of Toner Mother Particle (4)>

The same manner as in the production of toner mother particle (1) was performed except that the materials were changed to amorphous polyester resin particle dispersion liquid (a1): 400 parts by mass amorphous vinyl resin particle dispersion liquid (b1): 640 parts by mass crystalline polyester resin particle dispersion liquid (c1): 160 parts by mass release agent particle dispersion liquid (W1): 160 parts by mass black colorant particle dispersion liquid (1): 187 parts by mass anionic surfactant (aqueous 20% Dowfax 2A1 solution): 40 parts by mass and ion exchange water: 1500 parts by mass, thereby providing toner mother particle (4). Toner mother particle (4) obtained had a median size on a volume basis of 4.0 μm and an average degree of circularity of 0.970.

<Production of Toner Mother Particle (5)>

The same manner as in the production of toner mother particle (1) was performed except that the materials were changed to amorphous polyester resin particle dispersion liquid (a1): 1040 parts by mass crystalline polyester resin particle dispersion liquid (c1): 160 parts by mass release agent particle dispersion liquid (W1): 160 parts by mass black colorant particle dispersion liquid (1): 187 parts by mass anionic surfactant (aqueous 20% Dowfax 2A1 solution): 40 parts by mass and ion exchange water: 1500 parts by mass, thereby providing toner mother particle (5). Toner mother particle (5) obtained had a median size on a volume basis of 4.0 μm and an average degree of circularity of 0.973.

<Production of Toner Mother Particle (6)>

The same manner as in the production of toner mother particle (1) was performed except that the materials were changed to amorphous polyester resin particle dispersion liquid (a1): 1038 parts by mass amorphous vinyl resin particle dispersion liquid (b1): 2 parts by mass crystalline polyester resin particle dispersion liquid (c1): 160 parts by mass release agent particle dispersion liquid (W1): 160 parts by mass black colorant particle dispersion liquid (1): 187 parts by mass anionic surfactant (aqueous 20% Dowfax 2A1 solution): 40 parts by mass and ion exchange water: 1500 parts by mass, thereby providing toner mother particle (6). Toner mother particle (6) obtained had a median size on a volume basis of 4.0 μm and an average degree of circularity of 0.971.

<Production of Toner Mother Particle (7)>

The same manner as in the production of toner mother particle (1) was performed except that the materials were changed to amorphous polyester resin particle dispersion liquid (a1): 1032 parts by mass amorphous vinyl resin particle dispersion liquid (b1): 8 parts by mass crystalline polyester resin particle dispersion liquid (c1): 160 parts by mass release agent particle dispersion liquid (W1): 160 parts by mass black colorant particle dispersion liquid (1): 187 parts by mass anionic surfactant (aqueous 20% Dowfax 2A1 solution): 40 parts by mass and ion exchange water: 1500 parts by mass thereby providing toner mother particle (7). Toner mother particle (7) obtained had a median size on a volume basis of 4.0 μm and an average degree of circularity of 0.972.

<Production of Toner Mother Particle (8)>

The same manner as in the production of toner mother particle (1) was performed except that the materials were changed to amorphous polyester resin particle dispersion liquid (a1): 960 parts by mass amorphous vinyl resin particle dispersion liquid (b1): 80 parts by mass crystalline polyester resin particle dispersion liquid (c1): 160 parts by mass release agent particle dispersion liquid (W1): 160 parts by mass black colorant particle dispersion liquid (1): 187 parts by mass anionic surfactant (aqueous 20% Dowfax 2A1 solution): 40 parts by mass and ion exchange water: 1500 parts by mass, thereby providing toner mother particle (8). Toner mother particle (8) obtained had a median size on a volume basis of 4.0 μm and an average degree of circularity of 0.970.

<Production of Toner Mother Particle (9)>

The same manner as in the production of toner mother particle (1) was performed except that the materials were changed to amorphous polyester resin particle dispersion liquid (a1): 720 parts by mass amorphous vinyl resin particle dispersion liquid (b1): 320 parts by mass crystalline polyester resin particle dispersion liquid (c1): 160 parts by mass release agent particle dispersion liquid (W1): 160 parts by mass anionic surfactant (aqueous 20% Dowfax 2A1 solution): 40 parts by mass and ion exchange water: 1500 parts by mass, thereby providing toner mother particle (9). Toner mother particle (9) obtained had a median size on a volume basis of 4.0 μm and an average degree of circularity of 0.972.

<Production of Toner Mother Particle (10)>

The same manner as in the production of toner mother particle (1) was performed except that the materials were changed to amorphous polyester resin particle dispersion liquid (a1): 640 parts by mass amorphous vinyl resin particle dispersion liquid (b1): 400 parts by mass crystalline polyester resin particle dispersion liquid (c1): 160 parts by mass release agent particle dispersion liquid (W1): 160 parts by mass black colorant particle dispersion liquid (1): 187 parts by mass anionic surfactant (aqueous 20% Dowfax 2A1 solution): 40 parts by mass and ion exchange water: 1500 parts by mass, thereby providing toner mother particle (10). Toner mother particle (10) obtained had a median size on a volume basis of 4.0 μm and an average degree of circularity of 0.970.

<Production of Toner Mother Particle (11)>

The same manner as in the production of toner mother particle (1) was performed except that the materials were changed to amorphous vinyl resin particle dispersion liquid (b1): 1040 parts by mass crystalline polyester resin particle dispersion liquid (c1): 160 parts by mass release agent particle dispersion liquid (W1): 160 parts by mass black colorant particle dispersion liquid (1): 187 parts by mass anionic surfactant (aqueous 20% Dowfax 2A1 solution): 40 parts by mass and ion exchange water: 1500 parts by mass, thereby providing toner mother particle (11). Toner mother particle (11) obtained had a median size on a volume basis of 4.0 μm and an average degree of circularity of 0.971.

TABLE I

| | Amorphous polyester resin (A1) | | Amorphous vinyl resin (B1) | | Crystalline polyester resin (C1) | | Toner mother particle | |
|---|---|---|---|---|---|---|---|---|
| Toner mother particle No | Amount of dispersion liquid (a1) [parts by mass] | Content in binding resin [% by mass] | Amount of dispersion liquid (b1) [parts by mass] | Content in binding resin [% by mass] | Amount of dispersion liquid (c1) [parts by mass] | Content in binding resin [% by mass] | Median size on volume basis [μm] | Average degree of circularity |
| 1 | 1008/400 | 88.0 | 32 | 2.0 | 160 | 10.0 | 4.0 | 0.971 |
| 2 | 1008/400 | 88.0 | 32 | 2.0 | 160 | 10.0 | 3.0 | 0.972 |
| 3 | 1008/400 | 88.0 | 32 | 2.0 | 160 | 10.0 | 5.0 | 0.969 |
| 4 | 400/400 | 50.0 | 640 | 40.0 | 160 | 10.0 | 4.0 | 0.970 |
| 5 | 1040/400 | 90.0 | — | — | 160 | 10.0 | 4.0 | 0.973 |
| 6 | 1038/400 | 89.9 | 2 | 0.1 | 160 | 10.0 | 4.0 | 0.971 |
| 7 | 1032/400 | 89.5 | 8 | 0.5 | 160 | 10.0 | 4.0 | 0.972 |
| 8 | 960/400 | 85.0 | 80 | 5.0 | 160 | 10.0 | 4.0 | 0.970 |
| 9 | 720/400 | 70.0 | 320 | 20.0 | 160 | 10.0 | 4.0 | 0.972 |
| 10 | 640/400 | 65.0 | 400 | 25.0 | 160 | 10.0 | 4.0 | 0.970 |
| 11 | 0/400 | 25.0 | 1040 | 65.0 | 160 | 10.0 | 4.0 | 0.971 |
| 12 | 1008/400 | 88.0 | 32 | 2.0 | 160 | 10.0 | 2.8 | 0.971 |
| 13 | 1008/400 | 88.0 | 32 | 2.0 | 160 | 10.0 | 5.2 | 0.972 |

<Preparation of Spherical Silica Particle (1)-1>

(1) To a 3-L reactor equipped with a stirring machine, a dropping funnel and a thermometer were added 945 parts by mass of methanol, 45 parts by mass of 28% ammonia water and 135 parts by mass of water, and mixed. While the resulting solution was stirred with the temperature thereof being adjusted at 35° C., 405 parts by mass of tetramethoxysilane was added dropwise over 6 hours. After the dropwise addition, stirring was further continued for 1 hour and hydrolysis was performed, thereby providing a silica particle suspension.

(2) To the aqueous suspension was added dropwise 4.8 parts by mass of methyltrimethoxysilane at room temperature, and a hydrophobization treatment of the silica particle surface was performed.

(3) The dispersion liquid thus obtained was heated to 80° C. for distilling off methanol and water. To the resulting dispersion liquid was added 130 parts by mass of hexamethyldisilazane at room temperature, and heated to 60° C. to allow a reaction to run for 9 hours for trimethylsilylation of the silica particle. Thereafter, the solvent was distilled off under reduced pressure, and thus silica particle (1)-1 was prepared.

The number average particle size and the standard deviation of silica particle (1)-1 obtained by the above method were measured, and the number average particle size was 40 nm and the standard deviation was 5 nm.

<Preparation of Spherical Silica Particles (1)-2 to (1)-5 and (2)-1 to (2)-5>

The preparation of spherical silica particle (1)-1 was conducted with adjustment of the number average particle size by control of the mass ratio, the reaction temperature, the stirring rate and the respective feeding rates of alkoxysilane, ammonia, alcohol and water in the hydrolysis and polycondensation, thereby preparing silica particles (1)-2 to (1)-5 and (2)-1 to (2)-5 described in Table II.

TABLE II

| | No. | Number average particle size [nm] | Sphericity |
|---|---|---|---|
| Spherical silica particle (1) | (1)-1 | 40 | 0.85 |
| | (1)-2 | 20 | 0.83 |

TABLE II-continued

| | No. | Number average particle size [nm] | Sphericity |
|---|---|---|---|
| | (1)-3 | 55 | 0.85 |
| | (1)-4 | 15 | 0.75 |
| | (1)-5 | 60 | 0.80 |
| Spherical silica particle (2) | (2)-1 | 110 | 0.85 |
| | (2)-2 | 65 | 0.75 |
| | (2)-3 | 70 | 0.78 |
| | (2)-4 | 160 | 0.86 |
| | (2)-5 | 180 | 0.86 |

<Production of Toner Particle 1>

(Addition of External Additive)

To 100 parts by mass of toner mother particle 1 (median size on a volume basis: 4.0 μm) were added 1.10 parts by mass of spherical silica particle (1)-1 (number average particle size=40 nm) and 1.50 parts by mass of spherical silica particle (2)-1 (number average particle size=110 nm), and mixed by a Henschel mixer for 20 minutes, thereby producing toner particle 1.

<Production of Toner Particles 2, 3, 19 and 20>

The production of toner particle 1 was conducted with spherical silica particle (1)-1 being changed to spherical silicas (1)-2 to (1)-5 as described in Table III, thereby producing toner particles 2, 3, 19 and 20, respectively.

<Production of Toner Particle 4>

With toner mother particle 1 (100 parts by mass) was mixed 2.6 parts by mass of spherical silica particle (1)-1 (number average particle size=40 nm) by a Henschel mixer for 20 minutes, thereby producing toner particle 4.

<Production of Toner Particles 5 to 8>

The production of toner particle 1 was conducted with spherical silica particle (2)-1 being changed to spherical silicas (2)-2 to (2)-5 as described in Table III, thereby producing toner particles 5 to 8, respectively.

<Production of Toner Particle 9>

To 100 parts by mass of toner mother particle 2 (median size on a volume basis: 3.0 μm) were added 1.96 parts by mass of spherical silica particle (1)-1 (number average particle size=40 nm) and 2.67 parts by mass of spherical silica particle (2)-1 (number average particle size=110 nm), and mixed by a Henschel mixer for 20 minutes, thereby producing toner particle 9.

<Production of Toner Particle 10>

To 100 parts by mass of toner mother particle 3 (median size on a volume basis: 5.0 μm) were added 0.70 parts by mass of spherical silica particle (1)-1 (number average particle size=40 nm) and 0.96 parts by mass of spherical silica particle (2)-1 (number average particle size=110 nm), and mixed by a Henschel mixer for 20 minutes, thereby producing toner particle 10.

<Production of Toner Particle 22>

To 100 parts by mass of toner mother particle 12 (median size on a volume basis: 2.8 μm) were added 2.24 parts by mass of spherical silica particle (1)-1 (number average particle size=40 nm) and 3.06 parts by mass of spherical silica particle (2)-1 (number average particle size=110 nm), and mixed by a Henschel mixer for 20 minutes, thereby producing toner particle 22.

<Production of Toner Particle 23>

To 100 parts by mass of toner mother particle 13 (median size on a volume basis: 5.2 μm) were added 0.65 parts by mass of spherical silica particle (1)-1 (number average particle size=40 nm) and 0.89 parts by mass of spherical silica particle (2)-1 (number average particle size=110 nm), and mixed by a Henschel mixer for 20 minutes, thereby producing toner particle 23.

<Production of Toner Particles 11 to 17 and 21>

The same manner as in the production of toner particle 1 was performed except that toner mother particle 1 was changed to toner mother particles described in Table III, thereby producing toner particles 11 to 17 and 21, respectively.

<Production of Toner Particle 18>

To 100 parts by mass of toner mother particle 1 (median size on a volume basis: 4.0 μm) were added 1.10 parts by mass of a non-spherical silica particle (number average particle size: 40 nm, sphericity: 0.5, fumed silica) and 1.50 parts by mass of spherical silica particle (2)-1 (number average particle size=110 nm), and mixed by a Henschel mixer for 20 minutes, thereby producing toner particle 18.

The median size on a volume basis of each toner particle produced is as shown in Table V below.

TABLE III

| Toner particle No. | Toner mother particle No. | Amorphous polyester resin (A1) Content in binding resin [% by mass] | Amorphous vinyl resin (B1) Content in binding resin [% by mass] | Crystalline polyester resin (C1) Content in binding resin [% by mass] | Spherical silica particle (1) No. | Spherical silica particle (1) Number average particle size [nm] | Spherical silica particle (2) No. | Spherical silica particle (2) Number average particle size [nm] |
|---|---|---|---|---|---|---|---|---|
| 1 | 1 | 88.0 | 2.0 | 10.0 | (1)-1 | 40 | (2)-1 | 110 |
| 2 | 1 | 88.0 | 2.0 | 10.0 | (1)-2 | 20 | (2)-1 | 110 |
| 3 | 1 | 88.0 | 2.0 | 10.0 | (1)-3 | 55 | (2)-1 | 110 |
| 4 | 1 | 88.0 | 2.0 | 10.0 | (1)-1 | 40 | — | — |
| 5 | 1 | 88.0 | 2.0 | 10.0 | (1)-1 | 40 | (2)-2 | 65 |
| 6 | 1 | 88.0 | 2.0 | 10.0 | (1)-1 | 40 | (2)-3 | 70 |
| 7 | 1 | 88.0 | 2.0 | 10.0 | (1)-1 | 40 | (2)-4 | 160 |
| 8 | 1 | 88.0 | 2.0 | 10.0 | (1)-1 | 40 | (2)-5 | 180 |
| 9 | 2 | 88.0 | 2.0 | 10.0 | (1)-1 | 40 | (2)-1 | 110 |
| 10 | 3 | 88.0 | 2.0 | 10.0 | (1)-1 | 40 | (2)-1 | 110 |
| 11 | 4 | 50.0 | 40.0 | 10.0 | (1)-1 | 40 | (2)-1 | 110 |
| 12 | 5 | 90.0 | — | 10.0 | (1)-1 | 40 | (2)-1 | 110 |
| 13 | 6 | 89.9 | 0.1 | 10.0 | (1)-1 | 40 | (2)-1 | 110 |
| 14 | 7 | 89.5 | 0.5 | 10.0 | (1)-1 | 40 | (2)-1 | 110 |
| 15 | 8 | 85.0 | 5.0 | 10.0 | (1)-1 | 40 | (2)-1 | 110 |
| 16 | 9 | 70.0 | 20.0 | 10.0 | (1)-1 | 40 | (2)-1 | 110 |
| 17 | 10 | 65.0 | 25.0 | 10.0 | (1)-1 | 40 | (2)-1 | 110 |
| 18 | 1 | 88.0 | 2.0 | 10.0 | — | — | (2)-1 | 110 |
| 19 | 1 | 88.0 | 2.0 | 10.0 | (1)-4 | 15 | (2)-1 | 110 |
| 20 | 1 | 88.0 | 2.0 | 10.0 | (1)-5 | 60 | (2)-1 | 110 |
| 21 | 11 | 25.0 | 65.0 | 10.0 | (1)-1 | 40 | (2)-1 | 110 |
| 22 | 12 | 88.0 | 2.0 | 10.0 | (1)-1 | 40 | (2)-1 | 110 |
| 23 | 13 | 88.0 | 2.0 | 10.0 | (1)-1 | 40 | (2)-1 | 110 |

<Production of Core Particle 1>

Raw materials were weighed so that the following was satisfied: MnO: 35% by mol, MgO: 14.5% by mol, $Fe_2O_3$: 50% by mol and SrO: 0.5% by mol; and mixed with water, and thereafter the mixture was pulverized by a wet media mill for 5 hours, thereby providing a slurry.

The resulting slurry was dried by a spray drier, thereby providing a true spherical-shaped particle. The particle was adjusted in terms of the particle size, and thereafter heated at 950° C. for 2 hours and calcined by a rotary kiln After the resultant was pulverized by a dry ball mill with stainless beads having a diameter of 0.3 cm for 1 hour, PVA as a binder was added in an amount of 0.8% by mass relative to the solid content, water and a dispersant were further added, and the resultant was pulverized with zirconia beads having a diameter of 0.5 cm for 25 hours.

Next, the resultant was granulated and dried by a spray drier, retained in an electrical furnace at a temperature of 1050° C. for 20 hours, and fired.

Thereafter, the resultant was subjected to crushing, further classification and thus adjustment of the particle size, and thereafter fractionation of a low-magnetic product by electromagnetic separation, thereby providing core particle 1. Core particle 1 had a volume average particle size of 28.0 μm.

<Production of Coating Resin 1>

A mixed and dissolved product of 100 parts by mass of a cyclohexyl methacrylate monomer and 1 part by mass of dodecanethiol was subjected to emulsion polymerization in a flask with a solution of 0.5 parts by mass of an anionic surfactant (Neogen SC manufactured by DKS Co. Ltd.) in 400 parts by mass of ion exchange water, and 0.5 parts by mass of ammonium persulfate as an initiator dissolved in 50 parts by mass of ion exchange water was loaded thereto with slow mixing for 10 minutes. After purging with nitrogen, the content in the flask was heated to 70° C. by an oil bath with stirring, and subjected to emulsion polymerization for 5 hours as it was, thereby providing a resin dispersion liquid. Thereafter, the resin dispersion liquid was spray-dried, thereby providing coating resin 1. Coating resin 1 had a weight average molecular weight of 350000.

<Production of Carrier Particle 1>

A high-speed stirring/mixing machine equipped with a horizontal stirring blade was charged with 100 parts by mass of core particle 1 above prepared as a core particle and 4.5 parts by mass of coating resin 1, and the resultant was stirred at 22° C. for 15 minutes in a condition where the circumferential velocity of the horizontal stirring blade was 8 msec, then mixed at 120° C. for 50 minutes to allow the surface of the core particle to be coated with a coating material by the action of a mechanical impact force (mechanochemical method), and then cooled to room temperature, thereby producing carrier particle 1.

<Production of Carrier Particle 2>

The same manner as in the production of carrier particle 1 was performed except that the amount of coating resin 1 was changed to 5.5 parts by mass and the mixing time at 120° C. was changed to 20 minutes, thereby producing carrier particle 2.

<Production of Carrier Particle 3>

The same manner as in the production of carrier particle 1 was performed except that the amount of coating resin 1 was changed to 5.5 parts by mass and the mixing time at 120° C. was changed to 40 minutes, thereby producing carrier particle 3.

<Production of Carrier Particle 4>

The same manner as in the production of carrier particle 1 was performed except that the amount of coating resin 1 was changed to 3.5 parts by mass and the mixing time at 120° C. was changed to 70 minutes, thereby producing carrier particle 4.

<Production of Carrier Particle 5>

The same manner as in the production of carrier particle 1 was performed except that the amount of coating resin 1 was changed to 3.5 parts by mass and the mixing time at 120° C. was changed to 90 minutes, thereby producing carrier particle 5.

The respective percentages of exposed area of the carrier particles produced were determined in the same manner as in those of the core particles, and were represented in the following Table.

TABLE IV

| | Core particle | | | | | |
|---|---|---|---|---|---|---|
| | | Volume average | Coating resin | | Treatment time | Percentage of exposed |
| Carrier particle No. | No. | particle size [μm] | No. | Amount added [parts by mass] | at 120° C. [min] | area of core particle [%] |
| 1 | 1 | 28 | 1 | 4.5 | 50 | 14.2 |
| 2 | 1 | 28 | 1 | 5.5 | 20 | 9.2 |
| 3 | 1 | 28 | 1 | 5.5 | 40 | 10.0 |
| 4 | 1 | 28 | 1 | 3.5 | 70 | 18.0 |
| 5 | 1 | 28 | 1 | 3.5 | 90 | 18.8 |

<Production of Developer 1>

Toner particle 1 and carrier particle 1 produced as described above were mixed so that the toner concentration was 9% by mass, thereby producing developer 1. The mixing machine used was a V-type mixing machine (manufactured by Tokuju Co., Ltd.), and mixing was conducted at 25° C. for 30 minutes.

<Production of Developers 2 to 27>

The same manner as in the production of developer 1 was performed except that respective combinations of a toner particle and a carrier particle were as represented in Table V below, thereby producing developers 2 to 27.

TABLE V

| Developer No. | Toner mother particle No. | Toner mother particle Median size on volume basis [μm] | Amorphous polyester resin (A1) Content in binding resin [% by mass] | Amorphous vinyl resin (B1) Content in binding resin [% by mass] | Crystalline polyester resin (C1) Content in binding resin [% by mass] | Spherical silica particle (1) No. | Spherical silica particle (1) Number average particle size [nm] |
|---|---|---|---|---|---|---|---|
| 1 | 1 | 4.0 | 88.0 | 2.0 | 10.0 | (1)-1 | 40 |
| 2 | 1 | 4.0 | 88.0 | 2.0 | 10.0 | (1)-2 | 20 |
| 3 | 1 | 4.0 | 88.0 | 2.0 | 10.0 | (1)-3 | 55 |
| 4 | 1 | 4.0 | 88.0 | 2.0 | 10.0 | (1)-1 | 40 |
| 5 | 1 | 4.0 | 88.0 | 2.0 | 10.0 | (1)-1 | 40 |
| 6 | 1 | 4.0 | 88.0 | 2.0 | 10.0 | (1)-1 | 40 |
| 7 | 1 | 4.0 | 88.0 | 2.0 | 10.0 | (1)-1 | 40 |
| 8 | 1 | 4.0 | 88.0 | 2.0 | 10.0 | (1)-1 | 40 |
| 9 | 2 | 3.0 | 88.0 | 2.0 | 10.0 | (1)-1 | 40 |
| 10 | 3 | 5.0 | 88.0 | 2.0 | 10.0 | (1)-1 | 40 |
| 11 | 4 | 4.0 | 50.0 | 40.0 | 10.0 | (1)-1 | 40 |
| 12 | 5 | 4.0 | 90.0 | — | 10.0 | (1)-1 | 40 |
| 13 | 6 | 4.0 | 89.9 | 0.1 | 10.0 | (1)-1 | 40 |
| 14 | 7 | 4.0 | 89.5 | 0.5 | 10.0 | (1)-1 | 40 |
| 15 | 8 | 4.0 | 85.0 | 5.0 | 10.0 | (1)-1 | 40 |
| 16 | 9 | 4.0 | 70.0 | 20.0 | 10.0 | (1)-1 | 40 |
| 17 | 10 | 4.0 | 65.0 | 25.0 | 10.0 | (1)-1 | 40 |
| 18 | 1 | 4.0 | 88.0 | 2.0 | 10.0 | (1)-1 | 40 |
| 19 | 1 | 4.0 | 88.0 | 2.0 | 10.0 | (1)-1 | 40 |
| 20 | 1 | 4.0 | 88.0 | 2.0 | 10.0 | (1)-1 | 40 |
| 21 | 1 | 4.0 | 88.0 | 2.0 | 10.0 | (1)-1 | 40 |
| 22 | 1 | 4.0 | 88.0 | 2.0 | 10.0 | — | — |
| 23 | 1 | 4.0 | 88.0 | 2.0 | 10.0 | (1)-4 | 15 |
| 24 | 1 | 4.0 | 88.0 | 2.0 | 10.0 | (1)-5 | 60 |
| 25 | 11 | 4.0 | 25.0 | 65.0 | 10.0 | (1)-1 | 40 |
| 26 | 12 | 2.8 | 88.0 | 2.0 | 10.0 | (1)-1 | 40 |
| 27 | 13 | 5.2 | 88.0 | 2.0 | 10.0 | (1)-1 | 40 |

| Developer No. | Spherical silica particle (2) No. | Spherical silica particle (2) Number average particle size [nm] | Toner particle No. | Toner particle Median size on volume basis [μm] | Carrier particle No. | Carrier particle Percentage of exposed area of core particle [%] | Note |
|---|---|---|---|---|---|---|---|
| 1 | (2)-1 | 110 | 1 | 4.0 | 1 | 14.2 | Inventive |
| 2 | (2)-1 | 110 | 2 | 4.0 | 1 | 14.2 | Inventive |
| 3 | (2)-1 | 110 | 3 | 4.0 | 1 | 14.2 | Inventive |
| 4 | — | — | 4 | 4.0 | 1 | 14.2 | Inventive |
| 5 | (2)-2 | 65 | 5 | 4.0 | 1 | 14.2 | Inventive |
| 6 | (2)-3 | 70 | 6 | 4.0 | 1 | 14.2 | Inventive |
| 7 | (2)-4 | 160 | 7 | 4.0 | 1 | 14.2 | Inventive |
| 8 | (2)-5 | 180 | 8 | 4.0 | 1 | 14.2 | Inventive |
| 9 | (2)-1 | 110 | 9 | 3.0 | 1 | 14.2 | Inventive |
| 10 | (2)-1 | 110 | 10 | 5.0 | 1 | 14.2 | Inventive |
| 11 | (2)-1 | 110 | 11 | 4.0 | 1 | 14.2 | Inventive |
| 12 | (2)-1 | 110 | 12 | 4.0 | 1 | 14.2 | Inventive |
| 13 | (2)-1 | 110 | 13 | 4.0 | 1 | 14.2 | Inventive |
| 14 | (2)-1 | 110 | 14 | 4.0 | 1 | 14.2 | Inventive |
| 15 | (2)-1 | 110 | 15 | 4.0 | 1 | 14.2 | Inventive |
| 16 | (2)-1 | 110 | 16 | 4.0 | 1 | 14.2 | Inventive |
| 17 | (2)-1 | 110 | 17 | 4.0 | 1 | 14.2 | Inventive |
| 18 | (2)-1 | 110 | 1 | 4.0 | 2 | 9.2 | Inventive |
| 19 | (2)-1 | 110 | 1 | 4.0 | 3 | 10.0 | Inventive |
| 20 | (2)-1 | 110 | 1 | 4.0 | 4 | 18.0 | Inventive |
| 21 | (2)-1 | 110 | 1 | 4.0 | 5 | 18.8 | Inventive |
| 22 | (2)-1 | 110 | 18 | 4.0 | 1 | 14.2 | Comparative |
| 23 | (2)-1 | 110 | 19 | 4.0 | 1 | 14.2 | Comparative |
| 24 | (2)-1 | 110 | 20 | 4.0 | 1 | 14.2 | Comparative |
| 25 | (2)-1 | 110 | 21 | 4.0 | 1 | 14.2 | Comparative |
| 26 | (2)-1 | 110 | 22 | 2.8 | 1 | 14.2 | Comparative |
| 27 | (2)-1 | 110 | 23 | 5.2 | 1 | 14.2 | Comparative |

<Evaluation>

(Low-Temperature Fixability: Lowest Fixing Temperature)

A digital printer "bizhub PRESS C1070" (manufactured by Konica Minolta, Inc.) was altered with respect to a fixing apparatus so that the pressure and the processing speed (nip time) in a nip region were variable, and furthermore altered so that the surface temperature of a heat roller for fixing was variable in the range from 100 to 210° C. The respective developers produced from the toners were loaded into the copier.

The amount of attachment onto A4-sized premium grade paper "CF paper" (manufactured by Konica Minolta, Inc.) was set so as to be 5.0 g/m$^2$ under a normal temperature and normal pressure (20° C., 55% RH) environment. Thereafter, a fixing test that allowed an image having a size of 100 mm×100 mm to be fixed was repeatedly performed with the fixing temperature set being changed from 110° C. to 180° C. at an interval of 5° C.

The respective printed products obtained at the fixing temperatures were visually confirmed, and the lowest temperature where all the toners were fixed on the paper without any attachment to a fuser was defined as the lowest fixing temperature (° C.).

Excellent: the lowest fixing temperature was 130° C. or less (superior)

Good: the lowest fixing temperature was more than 130° C. and 140° C. or less (favorable)

Poor: the lowest fixing temperature was more than 140° C. (fail)

(Bottle Dischargeability)

The bottle dischargeability was determined according to the following criteria based on the presence of lighting of a toner empty sign in printing for 1000 sheets of A4-sized plain paper used as an image support in the following printing rate conditions under a normal temperature and normal pressure environment (temperature: 20° C., humidity: 55% RH) with a toner bottle filled with 1100 g of each of the developers. "Good" or higher rating was regarded as being non-problematic for practical use.

Excellent: no lighting of any empty sign even in printing for 1000 sheets at a printing rate of 100%.

Good: no lighting of any empty sign in printing for 1000 sheets at a printing rate of 70%, but lighting of an empty sign in printing for 1000 sheets at a printing rate of 80%.

Poor: lighting of an empty sign in printing for 1000 sheets even at a printing rate of 70%.

(Rate of Charge Rise)

After 20 g of each of the developers was placed in a 20-mL glass vessel, left to still stand at room temperature for one week and then shaken with a 50-cm arm 200 times per minute at a shaking angle of 45° for 1 minute in a normal temperature and normal pressure environment (temperature: 20° C., humidity: 55% RH) environment condition, 1 g of the developer was collected and the amount of charge thereof was measured by a blow-off method. The resulting value was defined as "Q1". The shaking was further continued for 120 minutes, thereafter 1 g of the developer was collected and the amount of charge thereof was measured by a blow-off method. The resulting value was defined as "Q2". The rate of charge rise (%) was calculated as the ratio of Q1 to Q2, and determined according to the following criteria. "Good" or higher rating was regarded as passing.

Excellent: the rate of charge rise was 90% or more.

Good: the rate of charge rise was 80% or more and less than 90%.

Poor: the rate of charge rise was less than 80%.

<<Evaluation of Image Quality after Continuous Printing>>

An image having a pixel ratio of 50% was formed on 1000000 sheets of A4 premium grade paper (64 g/m$^2$) with a combined machine "bizhub PRESS C1070" (manufactured by Konica Minolta, Inc.) in a normal temperature and normal pressure environment (20° C., 55% RH).

(Image Density Stability)

A 40% screen tint image throughout the entire surface thereof was output on A4-sized premium grade paper "CF paper" before and after printing for 1000000 sheets. The reflection density of the resulting image was measured by a Macbeth reflection densitometer "RD907" (manufactured by Macbeth Corp.), to determine the difference in reflection density of a halftone image before and after image formation on 1000000 sheets. In the present evaluation, an absolute value of the difference in reflection density, of 0.06 or less, was regarded as passing.

Excellent: the absolute value of the difference in reflection density was 0.03 or less.

Good: the absolute value of the difference in reflection density was more than 0.03 and 0.06 or less.

Poor: the absolute value of the difference in reflection density was more than 0.06.

(Granularity GI Value)

After printing for 1000000 sheets, a belt-like solid image having a printing rate of 40% was further printed for 500 sheets, thereafter a gradation pattern with 32 tones was output, and the granularity of the gradation pattern was evaluated according to the following criteria. The granularity was evaluated by subjecting the read value by CCD with respect to the gradation pattern, to Fourier transform processing in consideration of MTF (Modulation Transfer Function) correction, and measuring the GI value (Graininess Index) based on the human spectral luminous efficiency to determine the maximum GI value. A smaller GI value is more preferable. Herein, the GI value is a value set forth in Journal of the Imaging Society of Japan, 39 (2), pp. 84-93 (2000). In the present evaluation, a GI value of less than 0.195 was regarded as passing.

Excellent: less than 0.170

Good: 0.170 or more and less than 0.195

Poor: 0.195 or more

TABLE VI

| | | | Evaluation results | | | | | | | | | |
|---|---|---|---|---|---|---|---|---|---|---|---|---|
| | | | | | | | | | Image quality after continuous printing | | | |
| Developer No. | Toner particle No. | Carrier particle No. | Low-temperature fixability [° C.] | | Bottle dischargeability | Charge rising ability [%] | | Image density stability (difference in reflection density) | | Granularity GI value | | Note |
| 1 | 1 | 1 | 125 | Excellent | Excellent | 95 | Excellent | 0.01 | Excellent | 0.145 | Excellent | Inventive |
| 2 | 2 | 1 | 125 | Excellent | Good | 83 | Good | 0.05 | Good | 0.185 | Good | Inventive |
| 3 | 3 | 1 | 125 | Excellent | Good | 81 | Good | 0.05 | Good | 0.192 | Good | Inventive |
| 4 | 4 | 1 | 125 | Excellent | Good | 88 | Good | 0.05 | Good | 0.181 | Good | Inventive |
| 5 | 5 | 1 | 125 | Excellent | Excellent | 92 | Excellent | 0.04 | Good | 0.162 | Excellent | Inventive |
| 6 | 6 | 1 | 125 | Excellent | Excellent | 94 | Excellent | 0.03 | Excellent | 0.156 | Excellent | Inventive |
| 7 | 7 | 1 | 125 | Excellent | Excellent | 94 | Excellent | 0.03 | Excellent | 0.158 | Excellent | Inventive |
| 8 | 8 | 1 | 130 | Excellent | Excellent | 92 | Excellent | 0.04 | Good | 0.164 | Excellent | Inventive |
| 9 | 9 | 1 | 120 | Excellent | Good | 81 | Good | 0.02 | Excellent | 0.188 | Good | Inventive |
| 10 | 10 | 1 | 135 | Good | Excellent | 95 | Excellent | 0.02 | Excellent | 0.193 | Good | Inventive |

TABLE VI-continued

| | | | Evaluation results | | | | | | | | | | |
|---|---|---|---|---|---|---|---|---|---|---|---|---|---|
| | | | | | | | | | Image quality after continuous printing | | | | |
| Developer No. | Toner particle No. | Carrier particle No. | Low-temperature fixability [° C.] | | Bottle dischargeability | Charge rising ability [%] | | Image density stability (difference in reflection density) | | Granularity GI value | | Note |
| 11 | 11 | 1 | 140 | Good | Excellent | 85 | Good | 0.05 | Good | 0.185 | Good | Inventive |
| 12 | 12 | 1 | 125 | Excellent | Excellent | 86 | Good | 0.06 | Good | 0.178 | Good | Inventive |
| 13 | 13 | 1 | 125 | Excellent | Excellent | 89 | Good | 0.04 | Good | 0.168 | Excellent | Inventive |
| 14 | 14 | 1 | 125 | Excellent | Excellent | 92 | Excellent | 0.02 | Excellent | 0.155 | Excellent | Inventive |
| 15 | 15 | 1 | 125 | Excellent | Excellent | 92 | Excellent | 0.02 | Excellent | 0.158 | Excellent | Inventive |
| 16 | 16 | 1 | 135 | Good | Excellent | 87 | Good | 0.04 | Good | 0.166 | Excellent | Inventive |
| 17 | 17 | 1 | 140 | Good | Excellent | 82 | Good | 0.06 | Good | 0.173 | Good | Inventive |
| 18 | 1 | 2 | 125 | Excellent | Excellent | 91 | Excellent | 0.05 | Good | 0.177 | Good | Inventive |
| 19 | 1 | 3 | 125 | Excellent | Excellent | 95 | Excellent | 0.03 | Excellent | 0.165 | Excellent | Inventive |
| 20 | 1 | 4 | 125 | Excellent | Excellent | 92 | Excellent | 0.03 | Excellent | 0.158 | Excellent | Inventive |
| 21 | 1 | 5 | 125 | Excellent | Excellent | 90 | Excellent | 0.05 | Good | 0.171 | Good | Inventive |
| 22 | 18 | 1 | 125 | Excellent | Poor | 76 | Poor | 0.09 | Poor | 0.210 | Poor | Comparative |
| 23 | 19 | 1 | 125 | Excellent | Poor | 80 | Good | 0.07 | Poor | 0.201 | Poor | Comparative |
| 24 | 20 | 1 | 125 | Excellent | Poor | 82 | Good | 0.07 | Poor | 0.207 | Poor | Comparative |
| 25 | 21 | 1 | 150 | Poor | Excellent | 74 | Poor | 0.08 | Poor | 0.198 | Poor | Comparative |
| 26 | 22 | 1 | 125 | Excellent | Poor | 70 | Poor | 0.06 | Good | 0.194 | Good | Comparative |
| 27 | 23 | 1 | 140 | Good | Excellent | 94 | Excellent | 0.06 | Good | 0.205 | Poor | Comparative |

It can be seen from the results shown in Table VI that the toner according to the present invention is more excellent in low-temperature fixability, bottle dischargeability and rate of charge rise than toners according to Comparative Examples. In particular, a high-quality image can be formed even in continuous printing at a high image density.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-051927, filed on Mar. 20, 2018, is incorporated herein by reference in its entirety.

What is claimed is:

1. An electrostatic charge image developing toner comprising a toner particle comprising a toner mother particle containing at least a binding resin, and an external additive attached onto a surface of the toner mother particle, wherein a median size on a volume basis of the toner particle is in the range from 3.0 to 5.0 μm, the binding resin contains at least an amorphous polyester resin as a main component, and a spherical silica particle (1) having a number average particle size in the range from 20 to 55 nm is comprised as the external additive.

2. The electrostatic charge image developing toner according to claim 1, wherein the spherical silica particle (1) having a number average particle size in the range from 20 to 55 nm, and a spherical silica particle (2) having a number average particle size in the range from 70 to 160 nm are comprised as the external additive.

3. The electrostatic charge image developing toner according to claim 1, wherein the binding resin contains an amorphous vinyl resin in an amount in the range from 0.1 to 20% by mass based on a total mass of the binding resin.

4. A two-component developer comprising the electrostatic charge image developing toner according to claim 1, and a carrier particle formed by coating a surface of a core particle with a coating resin.

5. The two-component developer according to claim 4, wherein a percentage of exposed area of the core particle in a surface of the carrier particle is in the range from 10.0 to 18.0%.

6. The electrostatic charge image developing toner according to claim 1, wherein the spherical silica particle (1) has a sphericity of 0.6 or greater, where sphericity of an actual particle=(surface area of a sphere having a same volume as the actual particle/surface area of the actual particle).

7. The electrostatic charge image developing toner according to claim 6, wherein the spherical silica particle (1) has a sphericity of 0.8 or greater.

* * * * *